US007431347B2

(12) United States Patent
Ernst et al.

(10) Patent No.: US 7,431,347 B2
(45) Date of Patent: Oct. 7, 2008

(54) HOLLOW SUCKER ROD CONNECTION WITH SECOND TORQUE SHOULDER

(75) Inventors: Hugo A Ernst, Buenos Aires (AR); Jose A Villasante, Buenos Aires (AR)

(73) Assignee: Siderca S.A.I.C., Buenos Aires (AR)

( * ) Notice: Subject to any disclaimer, the term of this patent is extended or adjusted under 35 U.S.C. 154(b) by 454 days.

(21) Appl. No.: 11/342,526

(22) Filed: Jan. 31, 2006

(65) Prior Publication Data

US 2006/0125234 A1 Jun. 15, 2006

Related U.S. Application Data

(63) Continuation-in-part of application No. 10/668,503, filed on Sep. 24, 2003, now Pat. No. 6,991,267.

(51) Int. Cl.
*F16L 25/00* (2006.01)
*F16L 15/00* (2006.01)

(52) U.S. Cl. ..... 285/333; 285/334; 285/390

(58) Field of Classification Search ..... 285/333, 285/334, 355, 390

See application file for complete search history.

(56) References Cited

U.S. PATENT DOCUMENTS

| | | | | |
|---|---|---|---|---|
| 262,086 | A | 8/1882 | Mithoff | 285/333 |
| 1,497,398 | A | 6/1924 | Axelson et al. | 285/39 |
| 1,849,066 | A | 3/1932 | Bridges | 403/333 |
| 1,851,714 | A | 3/1932 | McCullough | 403/295 |
| 2,070,077 | A | 2/1937 | Davis | 285/89 |
| 2,239,942 | A | 4/1941 | Stone et al. | 285/110 |
| 2,893,759 | A | 7/1959 | Blose | 285/334 |
| 2,940,787 | A | 6/1960 | Goodner | 403/47 |
| 3,054,628 | A | 9/1962 | Hardy et al. | 285/332.3 |
| 3,427,050 | A | 2/1969 | Krieg | 285/333 |
| 3,476,413 | A | 11/1969 | Coberly et al. | 285/332.3 |
| 4,377,302 | A | 3/1983 | Kohyama et al. | 285/334 |
| 4,600,225 | A | 7/1986 | Blose | 285/334 |
| 4,750,761 | A | 6/1988 | Watts | 285/333 |
| 4,813,717 | A | 3/1989 | Watts | 285/333 |

(Continued)

FOREIGN PATENT DOCUMENTS

| | | |
|---|---|---|
| FR | 2190237 | 1/1974 |

*Primary Examiner*—James M Hewitt
(74) *Attorney, Agent, or Firm*—Fitzpatrick, Cella, Harper & Scinto

(57) ABSTRACT

An elongated drive string assembly comprising a plurality of hollow sucker rods and connecting elements with an axis, connected together and between a drive head located at the surface of an oil well and a rotary pump located deep down hole in an oil well. Each hollow sucker rod has at least a first end comprising an internal female threaded surface engaging an external male threaded surface on a connecting element, such as a nipple. In order to further optimize the stress distribution between the elements, frustro-conical, non-symmetrical threads with a differential diametral taper are used. Preferably two torque shoulders with a maximized mean diameter and cross-sectional area are used to resist storing reactive torque in the drive string. The nipple free end defines a second torque shoulder that adds to the torque transmission during make-up while also defining a small seal at that free end to decrease corrosion erosion problems. This overall configuration ensures high yield torque, high shear strength, lowered stress concentration and a surprising resistance to storing reactive torque, which minimizes dangerous backspin when power to the sucker rod string is interrupted.

17 Claims, 25 Drawing Sheets

U.S. PATENT DOCUMENTS

| | | | | |
|---|---|---|---|---|
| 4,852,655 | A | 8/1989 | Guy | 166/380 |
| 4,955,644 | A | 9/1990 | Pfeiffer et al. | 285/333 |
| 5,427,418 | A | 6/1995 | Watts | 285/333 |
| 5,551,510 | A | 9/1996 | Mills | 166/68 |
| 5,895,079 | A | 4/1999 | Carstensen et al. | 285/333 |
| 5,906,400 | A | 5/1999 | Gandy | 285/333 |
| 5,931,511 | A | 8/1999 | DeLange et al. | 285/334 |
| 6,030,004 | A | 2/2000 | Schock et al. | 285/333 |
| 6,174,000 | B1 | 1/2001 | Nishi et al. | 285/333 |
| 6,237,967 | B1 | 5/2001 | Yamamoto et al. | 285/333 |
| 6,485,063 | B1 | 11/2002 | Olivier | 285/333 |
| 6,746,221 | B1 | 6/2004 | Havard | 417/555.2 |
| 6,991,267 | B2 | 1/2006 | Ernst et al. | 285/333 |
| 2004/0135370 | A1 | 7/2004 | Evans et al. | 285/333 |
| 2004/0174017 | A1 | 9/2004 | Brill et al. | 285/333 |

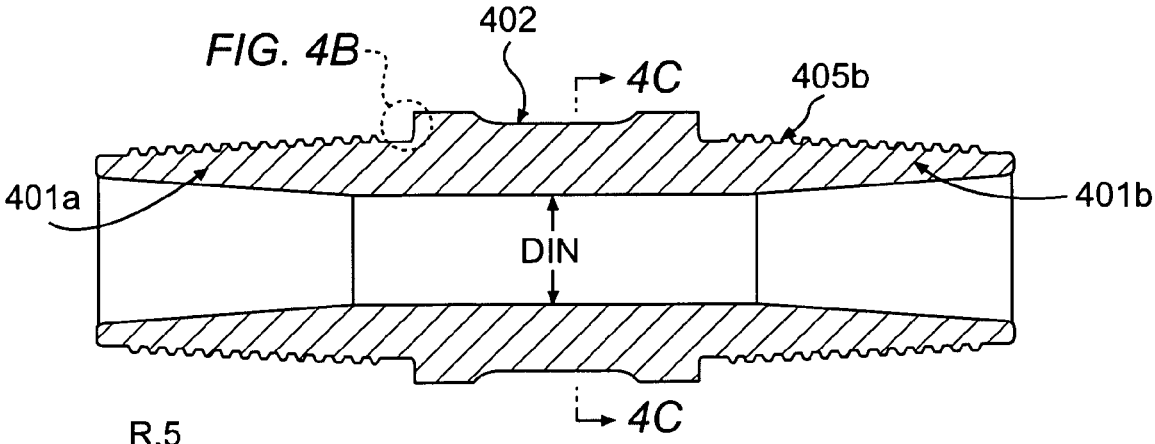
FIG. 4A
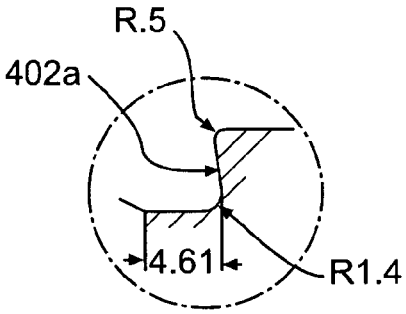
FIG. 4B
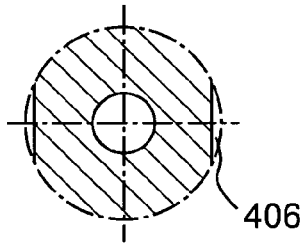
FIG. 4C
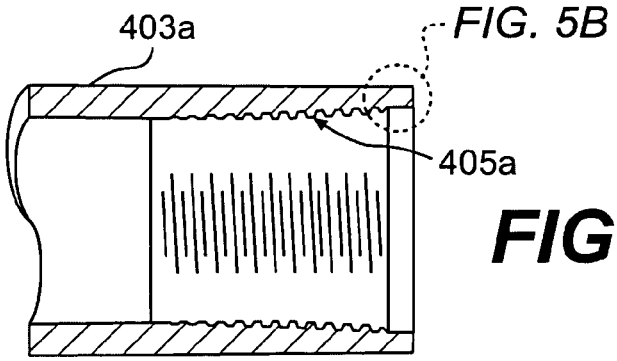
FIG. 5A
FIG. 5B
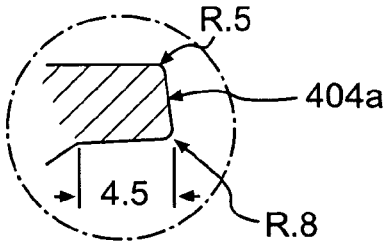

HOLLOW SUCKER ROD CONNECTION WITH SECOND TORQUE SHOULDER

BACKGROUND OF THE INVENTION

1. Field of the Invention

The present invention relates to the connection of a hollow sucker rod with a first and a second torque shoulder, and connecting elements with an axis, which are used to selectively rotate a rotary pump located deep down hole in an oil well from a drive head located at the surface of the oil well. The present invention comprises individual elements referred to herein as a "Hollow Sucker Rod" with at least a first end having a female thread and a "Connecting Element" which may be a separate "Nipple Connecting Element" with a pair of male threads or an integral male thread on a second, upset end of a Hollow Sucker Rod. In order to further optimize the stress distribution between the elements, frustro-conical, non-symmetrical threads with a differential diametral taper and two torque shoulders are used. The primary shoulder is located on the rod end and the secondary shoulder is located on the rod base. The hollow sucker rod and connecting element are dimensioned to obtain high operation torque, good fatigue resistance, good resistance to over torque and a surprising resistance to storing reactive torque, which minimizes dangerous backspin when power to the sucker rod string is interrupted.

2. Description of the Related Art

Non-surging oil well extraction is normally achieved by means of pumping systems. The most common system uses an alternating pump located at the bottom of the well driven by a sucker rod string that connects the bottom of the well with the surface, where an alternating pumping machine to drive the string up and down is located. The sucker rods in the prior art, therefore, were designed originally to simply reciprocate up and down, and were are manufactured to API Specification 11B using solid steel bars with an upset end and a threaded end, each thread being of solid cylindrical section. The rods typically were connected one with the other by means of a cylindrical threaded coupling. More efficient pumping is performed when an oil extracting progressive cavity pump (PCP), or like rotary down hole pump is used. Among other advantages, PCP pumping of oil allows for higher oil extraction rates, reduced fatigue loads, reduction in wear on the inside of production tubing, and the ability to pump high viscosity and high solids component oils. PCP pumps are installed at the bottom of the well and driven from the surface by an electric motor connected to a speed-reducing gearbox by means of a string of torque transmitting rods. Traditionally standard API sucker rods are used to drive PCP pumps notwithstanding the fact that these rods have not been designed to transmit torsional loads. The transmission of torque by means of conventional sucker rod strings presents the following disadvantages, i) low torque transmitting capacity, ii) high backspin iii) low resistance to overtorque, iv) big stiffness differential between the connection and the rod body, all factors that enhance the possibility of fatigue failures. The reason for rupture on this type of conventional rod is failure due to fatigue in the junction zone of the head of the rod with the body of same due to the difference in structural rigidity between both parts—the body of the rod and the head of the rod.

For a given cross sectional area, torque transmission by a hollow rod with an annular cross section is more efficient than with a narrower, solid circular cross section. With the above mentioned concept in mind the prior art includes a hollow sucker rod that simply uses a standard API external cylindrical thread on a first end connector and an internal API thread on a second end connector, each connector being butt welded to a pipe body, which creates significant and abrupt change in section between the pipe body and each connection body. (See, for example, EP 0145154 and JP04315605). The problem of sucker rod string backspin, and details of a drive head at the surface of an oil well and a rotary pump deep down hole in an oil well operation, which is the specific field of invention being addressed herein, can be found in Mills (U.S. Pat. No. 5,551,510), which is incorporated herein by reference.

The present invention is both specific to unique problems faced by a Hollow Sucker Rod, and categorically is different from threaded Drill Pipe connections in the following:

1) Drill pipe connections do not have severe constraints on the external dimensions of the pipe body and on the connection size. A hollow sucker rod external diameter is restricted to the internal diameter of the tubing, and typically is 2⅞" and 3½".
2) The flow speed of fluid that is conducted in the annular space between a hollow sucker rod and the inside of the well tubing is very limited, unlike the situation for a drill pipe.

Various thread and shoulder arrangements are discussed in the prior art with respect to joining together oil well drill pipe, well casing and tubing. See, for example, Pfeiffer et al. (U.S. Pat. No. 4,955,644); Carstenson (U.S. Pat. No. 5,895,079), Gandy (U.S. Pat. No. 5,906,400), Mithoff (U.S. Pat. No. 262,086), Blose (U.S. Pat. No. 4,600,225), Watts (U.S. Pat. Nos. 5,427,418; 4,813,717; 4,750,761), Shock et al. (U.S. Pat. No. 6,030,004), and Hardy et al. (U.S. Pat. No. 3,054,628). The Watts patents imply that a pre-1986 API standard for strings of casing and tubing was a straight thread, with a turned down collar and that his improvement comprised a flush joint tubular connection with both tapered threads and a shoulder torque. Watts also refer to API standards for tubing and casing where triangular and buttress threads can be used with a torque shoulder. The 1990 patent to Pfeiffer et al, and the 1996 patent to Carstensen et al, in contrast, refer to a more current API standard (truncated triangular thread, connection using a torque shoulder) for strings of casing and tubing that appears to involve frusto-conical threads and shoulders. Carstensen et al at col 7, line 9+ include a discussion about how a particular conical gradient and length of a thread defines stress distribution results. Likewise, Pfeiffer et al at col 2, line 51+ say their threads are tapered and according to "API standards" with their improvement essentially only having to do with transitional dimensions. Hence, the problem addressed by Pfeiffer is an assembly of drill pipe sections where it apparently was critical to use a compatible and standard non-differential thread according to API standards, and also with no incomplete threads and no torque shoulder specification. The main features of the Pfeiffer thread appear to be symmetrical, truncated triangle threads (between 4 and 6 threads per inch, 60° flank angle) and a thread height that is the same for the male and female thread (between 1.42 and 3.75 mm). Also, there is identical nominal taper on male and female ends (between 0.125 and 0.25). Shock et al. illustrate a particular tool joint for drill pipe where the unexpected advantage for drill pipe applications derives from tapered threads that significantly must be very coarse (3½ threads per inch) and have equal angle (75°) thread flanks and elliptical root surfaces.

Prior art connections for drillpipe, casing and tubing which employ some manner of a second torque shoulder are shown: Schock (U.S. Pat. No. 6,030,004); Hallez (U.S. Pat. No. 5,169,183); Hori (U.S. Pat. No. 5,549,336); Hall (U.S. Pat. No. 4,548,431); Olivier (U.S. Pat. No. 6,485,063B1); Blose (U.S. Pat. No. 4,192,533); and Stone (U.S. Pat. No. 1,932,427).

Table 1, below, the principal characteristics of such prior art connections are compared with a Hollow Sucker Rod with Second Torque Shoulder according to the present invention, and also compared to Hollow Sucker Rods with a single torque shoulder as illustrated by SIDERCA (U.S. Pat. No. 6,764,108).

TABLE 1

Principal Characteristics of Hollow Sucker Rods and others Connections with Second Torque Shoulder

| | Thread | | | | | |
|---|---|---|---|---|---|---|
| Product | Thread Shape | Threads per inch | Diametral Taper in/in on Diameter (Angle) | Thread height (mm) | Thread Completeness | Load and Stab Flank angle [°] (*1) |
| Hollow Rod with one torque shoulder (U.S. Pat. No. 6764108) | Non symmetrical truncated trapezoid | 8 | Differential N: 0.0976 (2.79°) P: 0.1 (2.86°) | N: 1.016 P: 1.016 | N: Complete P: Complete and Incomplete | LF: 4 SF: 9 |
| Hollow Rod with two torque shoulder | Non symmetrical truncated trapezoid | 6-8 | Differential N: 0.0976 (2.79°) P: 0.1 (2.86°) | N: 1.016 P: 1.016 | N: Complete P: Complete and Incomplete | LF: 4 SF: 9 |
| | | Connections with two or three torque shoulders | | | | |
| Schock Pat. (U.S. Pat. No. 6030004) | Symmetrical truncated trapezoid | 3½ | Non Differential (API-drill pipe) | N: ≧2.54 P: ≧2.54 | N: Complete P: Complete | LF: 32.5/42.5 SF: 32.5/42.5 |
| Hallez Pat. (U.S. Pat. No. 5169183) | Symmetrical truncated trapezoid | 6-8 3-13* | Non Differential N & P: 0.035 a 0.105 (1 a 3°) | NA Maybe similar to API | N: Complete P: Complete | NA |
| Hori Pat. (U.S. Pat. No. 5549336) | Symmetrical truncated triangle (API-Drill pipe) | 4-6 (API-Drill pipe) | Non Differential (API-drill pipe) | N & P: 1.42-3.75 (API-drill pipe) | N & P: Complete (API-drill pipe) | LF & SF: 30 (API-drill pipe) |
| Hall Pat. (U.S. Pat. No. 4548431) | Symmetrical truncated triangle (API-Drill pipe) | 4-6 (API-Drill pipe) | Non Differential (API-drill pipe) | N & P: 1.42-3.75 (API-drill pipe) | N & P: Complete (API-drill pipe) | LF & SF: 30 (API-drill pipe) |
| Olivier Pat. (U.S. Pat. No. 6485063B1) | Non symmetrical truncated trapezoid | NA | Non Differential N & P: 0.33 (9.37°) | N: h1 P: h2 h1 > h2 h1 − h2 = 0.05 mm | N: Complete and Incomplete P: Complete | LF: −15 SF: 20 \|SF\| > \|LF\| |
| Blose Pat. (U.S. Pat. No. 4192533) | Non symmetrical truncated trapezoid | NA | Non Differential | NA | N: Complete P: Complete | LF: −15 SF: 30 \|SF\| > \|LF\| |
| Stone Pat. (U.S. Pat. No. 1932427) | Symmetrical truncated trapezoid (Modified Acme) | NA | Non Differential N & P: 0.083 (2.5°) | NA | N: Complete P: Complete | NA |

| | Union | | | | | |
|---|---|---|---|---|---|---|
| Product | Internal bore form | Torque shoulder angle [°] | N° of Torque shoulder | Clearance (mm) (*3) | Principal Loads | Observations |
| Hollow Rod with one torque shoulder (U.S. Pat. No. 6764108) | Conical & Cylindrical | 7 | 1 | 1st. TS: 0.4 a 1.1 | Torsion-Tension-Bending | For hollow sucker rod Patent granted in USA, France and Argentina |
| Hollow Rod with two torque shoulder | Conical & Cylindrical | 7 | 2 | 1st. TS: 0.4 a 2.5 2nd. TS: 0.4 a 2.53 | Torsion-Tension-Bending | For hollow sucker rod Present invention |
| | Connections with two or three torque shoulders | | | | | |
| Schock Pat. (U.S. Pat. No. 6030004) | Cylindrical | 0 | 2 | NA (Maybe 1st. TS & 2nd. TS: 0) | Torsion-Tension-Bending | For drill pipe N: Stress relief Groove Thread: elliptical root surfaces |
| Hallez Pat. (U.S. Pat. No. 5169183) | Cylindrical | <2-6 | 2 | NA (Maybe 1st. TS & 2nd. TS: 0) | Torsion-Tension-Bending | For drill pipe N: Discharge groove Thread: Triangular, Trapezoidal or round |
| Hori Pat. (U.S. Pat. No. 5549336) | Cylindrical (API-drill | 0 | 2 | NA (Maybe 1st. TS: 0) | Torsion-Tension- | For drill pipe Interchangeable with API |

TABLE 1-continued

Principal Characteristics of Hollow Sucker Rods and others Connections with Second Torque Shoulder

| | | | | Thread | | |
|---|---|---|---|---|---|---|
| | pipe) | | | 2nd. TS: 0.1 a 0.5 | Bending | drill pipe |
| Hall Pat. (U.S. Pat. No. 4548431) | Cylindrical (API-drill pipe) | 0 | 2 | 1st. TS: c1 2nd. TS: c2 c1 ≦ c2 | Torsion-Tension-Bending | For drill pipe 2nd torque shoulder was only made for over torque N&P: Relief grooves |
| Olivier Pat. (U.S. Pat. No. 6485063B1) | Cylindrical | 0 | 2 | NA (Maybe 1st. TS & 2nd. TS: 0) | Torsion-Tension-Bending | For drill string Thread: LF has S-Shape TS: Curved Surface Thread: Buttress, API, ACME, etc. |
| Blose Pat. (U.S. Pat. No. 4192533) | Cylindrical | 5 | 3 | NA | — | For tubing, casing, linepipe and drillpipe |
| Stone Pat. (U.S. Pat. No. 1932427) | Cylindrical | 1st. TS: 30 2nd. TS: −40 | 2 | 1st. TS: c1 2nd. TS: c2 c1 ≧ c2 | — | For drillpipe and casing |

Nomenclature:
N = Nipple
P = Pipe
C = Coupling
NA = Not Applicable
LF = Load Flank
SF = Stab Flank
TS: Torque shoulder
(*1) Angle defined from a perpendicular to the pipe axis.
(*3) Clearance between torque shoulder surfaces of pipe and nipple after the hand-tightened of the connection;
1st. TS: First torque shoulder or external torque shoulder;
2nd. TS: Second torque shoulder or internal torque shoulder

TABLE 2

Principal Characteristics of Hollow Sucker Rods and others Connections with only one Torque Shoulder (U.S. Pat. No. 6764108)

| | Thread | | | | | |
|---|---|---|---|---|---|---|
| Product | Thread Shape | Threads per inch | Diametral Taper in/in on Diameter (Angle) | Thread height (mm) | Thread Completeness | Load and Stab Flank angle [°] (*1) |
| Hollow Rod with one torque shoulder (U.S. Pat. No. 6764108) | Non symmetrical truncated trapezoid | 8 | Differential N: 0.0976 (2.79°) P: 0.1 (2.86°) | N: 1.016 P: 1.016 | N: Complete P: Complete and Incomplete | LF: 4 SF: 9 |
| Hollow Rod with two torque shoulder | Non symmetrical truncated trapezoid | 6-8 | Differential N: 0.0976 (2.79°) P: 0.1 (2.86°) | N: 1.016 P: 1.016 | N: Complete P: Complete and Incomplete | LF: 4 SF: 9 |
| | | | Connections with one Torque Shoulder | | | |
| Pfeiffer Pat. | Symmetrical truncated triangle (API-Drill pipe) | 4-6 | Non Differential (ApI-drill pipe) | N & P: 1.42-3.75 (API-drill pipe) | N & P: Complete (API-drill pipe) | LF & SF: 30 (API-drill pipe) |
| Watts Pat. | Symmetrical truncated triangle (API-Tubing) | (API-Tubing) | Differential | Less than API | N: Complete P: Complete and Incomplete | LF: ≦15 |
| Drill Pipe (API) | Symmetrical truncated triangle | 4-6 | Non Differential N & P: 0.125-0.25 | N & P: 1.42-3.75 | N & P: Complete | LF & SF: 30 |
| Tubing API 8r | Symmetrical truncated triangle | 10-6 (*2) | Non Differential C & P: .0625 | 1.8 | C: Complete P: Complete and Incomplete | LF & SF:: 30 |
| Casing API 8r | Symmetrical truncated triangle | 8 | Non Differential C & P: .0625 | 1.8 | C: Complete P: Complete and Incomplete | LF & SF:: 30 |
| Casing API Buttress | Non symmetrical truncated trapezoid | 5 | Non Differential C & P: .0625 | 1.575 | C: Complete P: Complete and Incomplete | LF: 3 SF: 10 |

TABLE 2-continued

| Principal Characteristics of Hollow Sucker Rods and others Connections with only one Torque Shoulder (U.S. Pat. No. 6764108) | | | | | | | |
|---|---|---|---|---|---|---|---|
| Casing API Extreme Line | Symmetrical truncated trapezoid | 6 | Non Differential C & P: .0625 | Thread C: 1.52 P: 1.35 | | C: Complete P: Complete and Incomplete | LF: 6 |
| | | Union | | | | | |
| | Product | Internal bore form | Torque shoulder angle [°] | N° of Torque shoulder | External Surface of Connection | Principal Loads | Observations |
| | Hollow Rod with one torque shoulder (U.S. Pat. No. 6764108) | Conical & Cylindrical | 7 | 1 | Flush | Torsion-Tension-Bending. | For hollow sucker rod Patent granted in USA, France and Argentina |
| | Hollow Rod with two torque shoulder | Conical & Cylindrical | 7 | 2 | Flush | Torsion-Tension-Bending | For hollow sucker rod Present invention |
| | | | Connections with one Torque Shoulder | | | | |
| | Pfeiffer Pat. | Cylindrical (API-drill pipe) | NA | 1 | Non Flush | Torsion-Tension-Bending. | For drillpipe |
| | Watts Pat. | Cylindrical | — | 1 | Flush | Tension-Compression-Internal Pressure-External Pressure | For tubing |
| | Drill Pipe (API) | Cylindrical | 0 | 1 | Flush | Torsion-Tension-Bending. | For drillpipe |
| | Tubing API 8r | Cylindrical | NA | 1 | Non Flush | Tension-Compression-Internal Pressure-External Pressure | For tubing |
| | Casing API 8r | Cylindrical | NA | 1 | Non Flush | Tension-Compression-Internal Pressure-External Pressure | For casing |
| | Casing API Buttress | Cylindrical | NA | 1 | Non Flush | Tension-Compression-Internal Pressure-External Pressure | For casing |
| | Casing API Extreme Line | Cylindrical | 0 | 1 | Non Flush | Tension-Compression-Internal Pressure-External Pressure | For casing |

Nomenclature:
N = Nipple
P = Pipe
C = Coupling
NA = Not Applicable
LF = Load Flank
SF = Stab Flank
TS: Torque shoulder
(*1) Angle defined from a perpendicular to the pipe axis.
(*2) Non Upset Tubing 1.66" to 3.5": 10 threads per inch., 4" and 4.5": 8 threads per inch. Upset Tubing 1.66" and 1.9": 10 threads per inch, 2.325" to 4.5": 8 threads per inch.

Table 2, above, illustrates the principal characteristics of a hollow sucker connection with one torque shoulder, as compared to a hollow sucker rod with one torque shoulder. Another version of a single torque shoulder, with a second engagement surface that acts as a seal but does not transmit torque, is illustrated herein at FIGS. 13 and 14.

However, the different problem of backspin inherent in the intermittent operation of a sucker rod string when driving a PCP pump is not apparently addressed in any of these references. The design of the invention was made with certain specific constraints and requirements in mind.

First, the minimum diameter of a tubing on the inside of which the Hollow Rods must operate corresponds to API 2⅞" tubing (inner diameter=62 mm) and API 3½" tubing (inner diameter=74.2 mm). The oil extraction flow rate must be up to 500 cubic meters per day, maximum oil flow speed must be 4 meters per second. The above-mentioned values strongly restrict the geometry of the rods under design. Second, to ensure a Hollow Sucker Rod with a high yield torque so that maximum torque is transmitted to the PCP pump without damage to the Hollow Sucker Rod string. Third, to minimize and distribute stresses in the threaded sections. This requirement is met by using a particular conical thread, differential taper, low thread height and a conical bore in the sections under the threads. Fourth, the Hollow Sucker Rod must have good fatigue resistance. Fifth, to ensure low backspin, and high resistance to axial loads. Sixth, ease of make up and break out (assembly of mating threaded parts) must be ensured, and is by a tapered thread. Seventh, to ensure high resistance to unscrewing of the Hollow Sucker Rod due to backspin, or the counter-rotation of a sucker rod string when driving motor stops running and the pump acts as a motor. Eighth, to ensure high resistance to jump out of the Hollow Sucker Rod string (Hollow Rod parting at the threaded sections) by means of adequate thread profile and reverse angle on the torque shoulder. Ninth, to minimize head loss of the fluids that occasionally can be pumped on the inside of the Hollow Sucker Rod through the added advantage of a conical bore on the nipple and the secondary torque shoulder. Tenth, to ensure connection sealabilty due to a sealing at both torque shoulders, and also due to diametrical interference at the threads. Eleventh, a thread profile designed so as to optimize pipe wall thickness usage. Twelfth, to eliminate use of the welds due to susceptibility of welds to fatigue damage, sulphide stress cracking damage and also the higher costs of manufacturing. Thirteenth, when a fluid flows through the interior of the rod with reasonable speed, it produces early wear of the nipple and rod in the area where they connect (overlap), hence, a seal was introduced by virtue of a secondary torque shoulder at each end of the nipple, which also ensures high resistance to an over torque of the connection. Fourteenth, to substantially increase the flow of fluid extracted, holes in the rod body were drilled to allow the fluid flowing through the interior of the rod.

A first object of the present invention is to provide an assembly of sucker pump rods and either separate threaded unions, or an integral union at the second end of each sucker rod, to activate PCP and like rotary type pumps, capable of transmitting greater torque than the solid pump rods described in the API 11 B Norm and also possessing good fatigue resistance, and improved resistance to over torque. Additionally, the present invention seeks to define a threaded union for hollow sucker rods that is significantly different from, and incompatible with, the standard for sucker rod assemblies as defined in the API 11 B Norm, yet still can easily be assembled. In fact the modified buttress thread is unique in that it is differential. For example, API Buttress Casing requires non-differential threads, with the taper for both a pipe and a coupling being 0.625 inches/inch of diameter. Likewise, API 8r casing and API 8r tubing both also require non-differential threads, with the taper for both a pipe and a coupling being 0.625 inches/inch of diameter. Still further, each of API Buttress Casing, API 8r casing and API 8r tubing do not employ any manner of torque shoulder, let alone first and second torque shoulder. For example, in Table 2 the connections show one torque shoulder.

A related object of the present invention is to provide an assembly of pump rods and unions with lesser tendency to uncoupling of the unions whenever "backspin" occurs, whether by accident or when intentionally provoked by the deactivation of the pump drive. The present invention surprisingly and significantly decreases the stored torsional energy in a sucker rod string. The stored energy in the string is inversely proportional to the diameter of the rod, and is directly proportional to the applied torque and the length of the string.

Another object of the invention is to provide for an assembly of sucker rods which are hollow and configured with a bore to permit passage of tools (sensors for control of the well) and/or allow interior circulation of fluids (injection of solvents and/or rust inhibitors).

The two torque shoulder embodiments disclosed herein have bigger yield torque than a hollow sucker rod with only one torque shoulder, as illustrated by U.S. Pat. No. 6,764,108.

The two torque shoulder, eighth and ninth embodiments disclosed herein have a yield torque of the connection that is up to 110 percent more than an otherwise corresponding hollow sucker rod with only one torque shoulder.

Still another object of the invention is to further optimize the stress distribution between the elements, by the combination of using frustro-conical, non-symmetrical threads with a differential diametral taper and two torque shoulders. The primary or first rod torque shoulder is located on rod end and the secondary or second rod torque shoulder is located on the rod base. The hollow sucker rod and connecting element are dimensioned to obtain high operation torque, good fatigue resistance, good resistance to over torque and a surprising resistance to storing reactive torque, which minimizes dangerous backspin when power to the sucker rod string is interrupted.

SUMMARY OF THE INVENTION

The present invention addresses the foregoing needs in the art by providing a new type of Hollow Sucker Rod consisting essentially of a pipe central section, with or without an upset, with at least one internal or female conical thread at a first end having a thread vanishing on the inside of the rod and a conical external torque shoulder. That first end is configured to engage a corresponding external or male thread that is differential and also to abut against a conical torque shoulder on either another rod with an externally threaded integral Connecting Element as its second end, or one of the shoulders between the external threads of a separate Nipple Connecting Element. If separate Nipple Connecting Elements are used, then the sucker rod second end is always the same as the first end. If separate Nipple Connecting Element are not used, then the sucker rod second end is configured with an upset end having a male conical thread adapted to engage the first end of another Hollow Sucker Rod.

A Nipple Connecting Element consists essentially of a central cylindrical section with a pair of conical external torque shoulders. The torque shoulders have a maximized mean diameter and cross-sectional area to resist storing reactive torque in the drive string. The nipple preferably also has a wall section that increases towards the torque shoulders from each free end to increase fatigue resistance. In order to further optimize the stress distribution between the elements, a specific type of thread with a differential taper is used. The overall configuration ensures high shear strength, lowered stress concentration and a surprising resistance to storing reactive torque, which minimizes dangerous backspin when power to the sucker rod string is interrupted.

The Nipple Connecting Element member also has trapezoidal, non-symmetric male threads at each end or extreme, separated by a pair of shoulder engaging elements, but that male thread is differential as to the diametral taper of the female thread on at least the first end of a Hollow Sucker Rod. The threaded nipple and the rod can be joined with or without discontinuity of outer diameter. The ratio of the diameter of the union to the diameter of the rod may between 1 without discontinuity of diameters, to a maximum of 1.5. In this manner the mean value of the external diameter throughout the length of the string will always be greater to that of a solid rod with equivalent cross-sectional area mated to a conventional union means. Hence, for a given length of string and cross-sectional area, resistance to "backspin" will be greater in an assembly according to the present invention. The dimensions of the nipple also may be defined with a conical inner bore proximate the length of each threaded extreme, to further enhance an homogenous distribution of tensions throughout the length of each thread and in the central body portion of the Nipple Connecting Element. In this way it is possible to obtain a desired ratio of diameters of the threaded ending of the nipple with respect to the internal diameter, and a ratio of outside diameter of the nipple with respect to the internal diameter and an additional ratio between the external diameter of the nipple and the diameter of each threaded extreme.

In a first object of the present invention, the essential characteristic of a Hollow Sucker Rod is at least a first end of a tubular element threaded with a conical female thread which is configured as a Modified Buttress or SEC thread and vanishes on the inside of the tubular element, in combination with a conical frontal surface at an angle between 75° and 90°, known as a torque shoulder. The external diameter of the HSR 48x6 External Flush and the HSR 42x5 Upset embodiments comprise a tubular rod body element away from the ends being 48.8 mm or 42 mm and the external diameter of the tubular element in the upset end of a 42 mm rod being 50 mm. These dimensions are critical since sucker rods of that maximum diameter can fit within standard 2⅞ inch tubing (62 mm inside diameter). For 3½ inch tubing (74.2 mm inside diameter) the HSR 48x6 Upset, with a diameter at the upset end of 60.6 mm, can be used for maximum advantage. The thread shape is trapezoidal and non-symmetric, with a Diametrical taper in the threaded section. The Length of threads on at least the first end of the tubular element are incomplete due to vanishing of thread on the inside of the tubular element. There is an 83° angle (Beta) of the conical surface in the torque shoulder as shown in FIG. 2A. There are radii at the inner and outer tips of the torque shoulder. At the end of the threaded section a short cylindrical section on the inside of the threaded area transitions the threaded area to the bore of the tubular element.

In a first object of the present invention, the essential characteristic of a Nipple Connecting Element is a differential thread engagement on either side of a central section that is externally cylindrical with a larger cross-sectional area in the vicinity of the torque shoulder for surprisingly improved fatigue resistance. At either side of this central section external torque shoulders are located to mate with a torque shoulder on a first end of a Hollow Sucker Rod. The mean diameter and total cross-sectional area of the torque shoulder is maximized, to allow maximum torque handling.

In addition, either end of the nipple externally threaded is conical so to create a larger cross-sectional area in the vicinity of the torque shoulder and thereby surprisingly improve fatigue resistance. To achieve this advantage a narrowing conical inner bore starts proximate the free end of each threaded extreme and thereby defines an increasing wall thickness cross-section towards the central section of the nipple. The external diameter of the central section of the nipple is 50 mm or 60.6 mm and that central section may have a pair of machined diametrically opposite flat surfaces, to be engaged by a wrench during connection make up. The thread is a Modified Buttress thread, which creates a differential due to slightly different amounts of diametral thread taper on the rod and on the nipple. The thread shape also is trapezoidal and non-symmetric. All threads on the nipple are complete. A pair of conical surfaces act as torque shoulders with a conical frontal surface at an angle between 75° and 90°. There are radii at tips of the torque shoulder, both at an inner corner and an outer corner. Preferably, conical bores under each threaded section of the nipple are connected by a cylindrical bore to create a larger cross-sectional area in the immediate vicinity of the torque shoulder in order to surprisingly improve fatigue resistance.

The thread taper on the nipple and on the rod is slightly different (Differential Taper) to ensure optimal stress distribution. When the connection is made up the corresponding torque shoulders on the rod and on the nipple bear against each other so that a seal is obtained that precludes the seepage of pressurized fluids from the outside of the connection to the inside of said and vice-versa. This sealing effect is enhanced by the diametrical interference between the two mating threaded sections on the first end of the rod and on the nipple.

A fluid flowing through the interior of the rod with reasonable speed tends produce early wear of the nipple and rod in the area where they connect (overlap). This phenomenon can be attributed to the existence of an "stagnation area" where the fluids remains almost still (low velocity). To overcome that corrosion problem the invention includes modifications so that the "stagnation zone" does not exist any more and the fluid flows smoothly and with little turbulence. It is important to note that these modifications are small so that they do not alter significantly the stress distribution in the connection or the performance of the nipple.

For use with various of the embodiments, there is taught an improvement to achieve the objective of a substantially increased flow of fluid extracted, through a further modification to a hollow sucker rod by drilling a series of holes, according to Configurations 1 2 or 3, in the rod at the two extremes of the string, i.e., at the ground level and at the bottom of the well.

In the eighth and ninth embodiments, a pair of torque shoulders are used in combination with high diametrical interference on the threaded sections and high material mechanical properties.

The eighth and ninth embodiments represent a significant change from the earlier embodiments. A second torque shoulder and a bigger diametrical interference at the threads are introduced. The second torque shoulder is inside of the rod, near the end of the internal or female threads. The dimensions result from a detailed stress analysis performed to improve significantly its torque resistance. The second torque shoulder serves as a seal in manner of the seventh embodiment, but adds significant additional advantages. The preferred angle of the conical surface in the second torque shoulder is 83 degrees.

The stress distribution on the nipple and the rod allows a high torque transmitting capacity, a good fatigue resistance and a good resistance to over torque. Torque load to yielding on the eighth embodiment is 2100 lbft (110 percent more than the seventh embodiment, an HR 48x6 External Flush with only one Torque Shoulder).

The rod dimensions were obtained from a stress analysis. The nominal diameter of the thread also was obtained from a stress analysis. The thread is mainly complete, except for a small length, and is different from the first through the seventh embodiments, which have only one torque shoulder. The diametrical taper in the threaded section is similar to the seventh embodiment.

The end of the nipple works as a second torque shoulder of the union. The thickness of the end of the nipple is between 3.8 mm-4.2 mm, and the bore of the nipple is conical in each extreme. The preferred angle is between 3° 54'-9° 7'. The total length of the nipple is similar to the seventh embodiment.

The connection has diametrical interference between the two mating threaded sections on the rod and on the nipple. When the connection is hand-tightened, the clearance between torque shoulder surfaces of rod and nipple are:

$c1$=0.4-2.5 mm for primary torque shoulder and $c2$=0.4-2.8 mm for secondary torque shoulder, where $c2 \geqq c1$ and $0\ \text{mm} \leqq (c2-c1) \leqq 0.3\ \text{mm}$.

The second torque shoulder is moderately loaded and definitely transmits torque. It also serves as an effective seal and promotes smooth flowing of the fluid.

Hence the eighth and ninth embodiments suprisingly exhibit high torque transmitting capacity and a high resistance to over torque, as well as good erosion-corrosion resistance when a fluid flows though the inside of the pipe. When a fluid flows though the inside of the pipe, it does it smoothly and presents little turbulence. The preferred ratios for dimensions in the two torque shoulder invention are DHT1/DEN between 0.7 and 0.9; DIN1/DEN between 0.20 and 0.60; DIN1/DHT1 between 0.3 and 0.70; DEVU/DEV between 1.0 and 1.5; DIFR1/DHT1 between 1.0 and 1.1; DIFR1/DEVU between 0.75 and 0.95; DIVU/DIFR2 between 0.65 and 0.90; DIN2/DHT2 between 0.67 and 0.92; DEVU/DIVU between 0.40 and 0.70; DIFR2/DEVU between 0.55 and 0.85; and DIN1/DIN2 between 0.4 and 1.0.

A better understanding of these and other objects, features, and advantages of the present invention may be had by reference to the drawings and to the accompanying description, in which there are illustrated and described different embodiments of the invention. The embodiments are considered exemplary of parts of useful assembly possibilities, since various of the illustrated male ends will successfully mate with the illustrated female ends.

BRIEF DESCRIPTION OF THE DRAWINGS

FIGS. 4A, 4B and 4C respectively represent an axial section view, a shoulder detail view and a cross-section view along Line 4C-4C of a Nipple Connecting Element having first and second male threaded ends, according to a fourth embodiment of the invention, styled Hollow Rod 48x6 External Flush.

FIGS. 5A and 5B respectively represent an axial section view and a shoulder detail view of a Hollow Sucker Rod having a first female threaded end, according to the fourth embodiment of the invention.

DESCRIPTION OF THE PREFERRED EMBODIMENTS

Figure 1A:
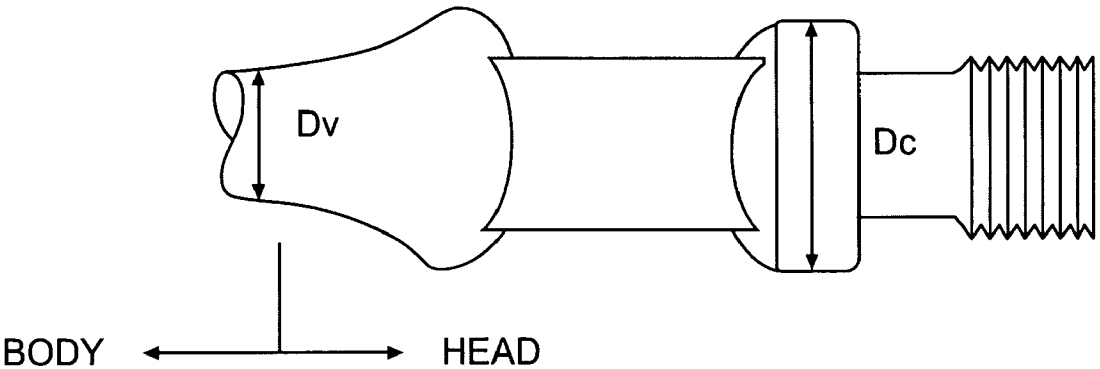
FIG. 1A PRIOR ART
FIGS. 1A and 1B, represent a Prior Art configuration of a conventional solid sucker rod as established in the API 11 B Norm specification.
Figure 1B:
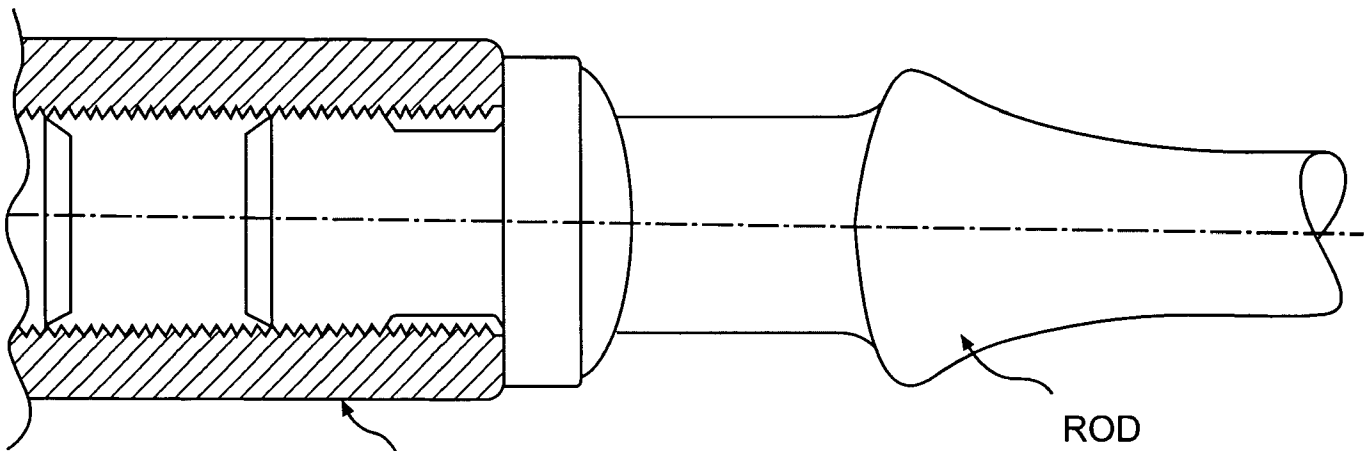
FIG. 1B PRIOR ART

FIG. 1A represents a common solid sucker rod with its conventional threaded first end or head with a cylindrical-type male thread. A large discontinuity between the head of the rod and the body of the rod can easily be seen. Diameters DC and DV, respectively. FIG. 1B is a schematic of the assembly of that solid pump rod with a conventional threaded union or collar according to the API 11B Norm.

Figure 2A:
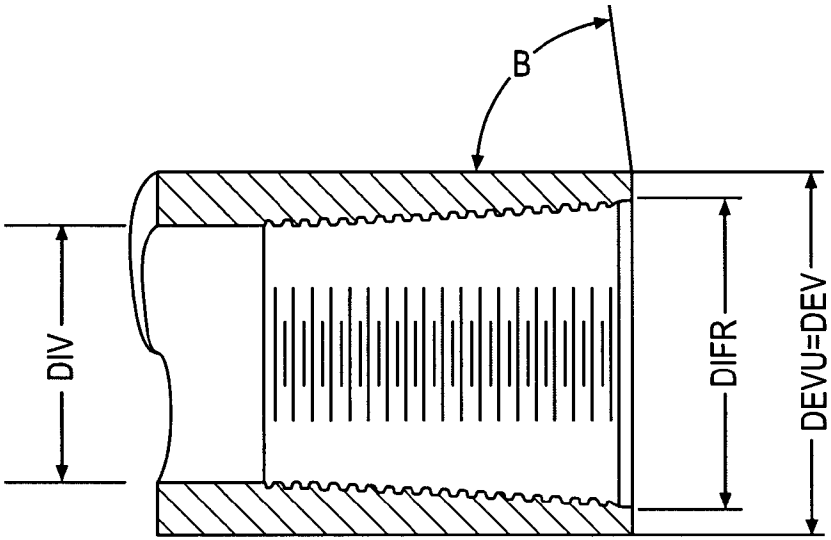
FIGS. 2A, 2B and 2C respectively represent general configurations of a Hollow Sucker Rod first end, a Nipple Connecting Element, and an assembly of both elements according to a first embodiment of the invention, with a constant outer diameter.
Figure 2B:
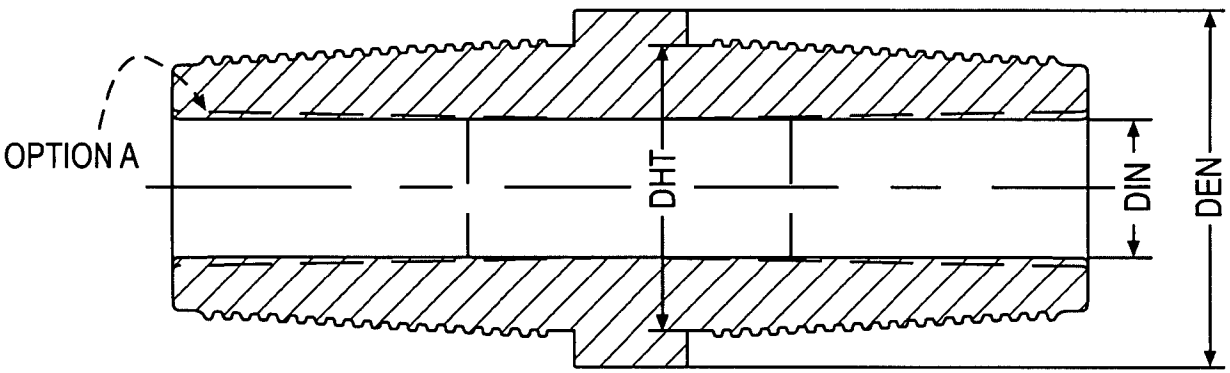
Figure 2C:
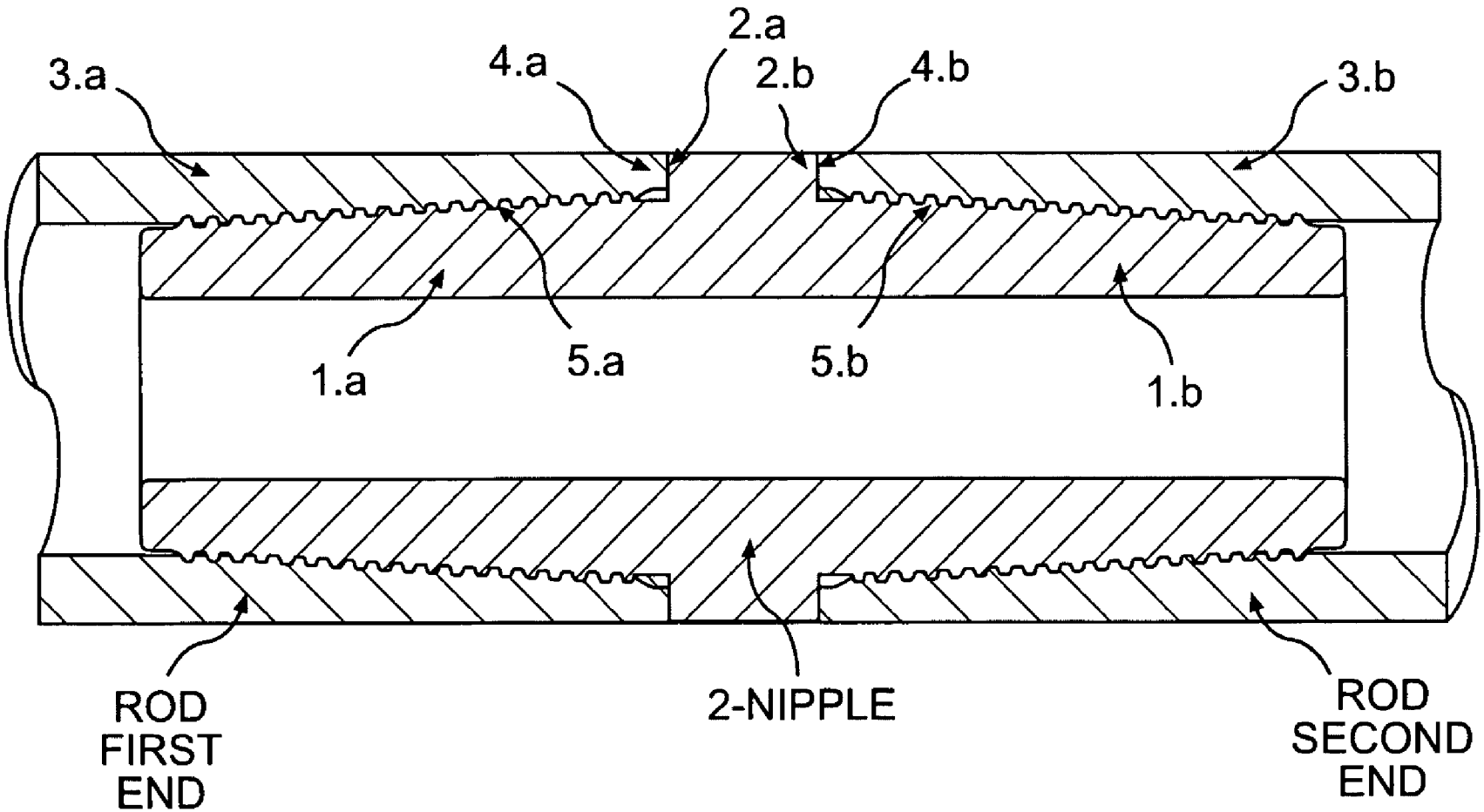

FIG. 2A-2C respectively represent general configurations of a Hollow Sucker Rod first end, a Nipple Connecting Element, and an assembly of both elements according to a first embodiment of the invention, with a constant outer diameter. FIG. 2A gives references at the female extreme of the hollow rod according to the invention. It is also possible to observe the frustro-conical shape threaded surface in the interior of the rod that diminishes in the internal diameter thereof. FIG. 2B gives references at the nipple or union according to the present invention. The external thread of frustro-conical shape and the presence of two torque shoulders can also be seen. It is also possible to observe the varying of the nipple inner bore diameter with conical shape labeled "Option A", as indicated by a broken line, which in turn creates a larger cross-sectional area in the vicinity of the torque should and surprisingly improves fatigue resistance.

FIG. 2C gives further references for the assembly of two hollow pump rods and one threaded union. It can be observed that the two female threads in the internal diameter of rod (3.*a* and 3.*b*) are joined to the corresponding male ends (1.*a* and 1.*b*) and how torque shoulders (2.*a* and 2.*b*) are part of nipple (2). The union between the corresponding male and female extremes is accomplished by differential engagement of the frustro-conical shape of the threads (5.*a* and 5.*b*). The fact that the thread shape is frustro-conical facilitates the initial setting of each piece and assembly of both parts. Shoulders located at the extreme free end surfaces of the first and second ends of the hollow rods (4.*a* and 4.*b*) engage, in the assembled position, against a pair of corresponding torque shoulders formed on the nipple (2.*a* and 2.*b*). Said contact planes form a torque shoulder angle (angle "Beta" see FIG. 2A) with respect to the axis of the rod, which angle being between 75° and 90° and most preferably being 83°.

FIG. 2B shows in general geometry references for a connecting element as a separate nipple and specifically defines outside diameter (DEN), internal diameter (DIN) and the start diameter of the torque shoulder (DHT). The connecting element for the invention is characterized by the ratios of diameters according to the Table 3:

| Diameter Ratios | Range Min. | Range Max. |
|---|---|---|
| DHT/DEN | 0.60 | 0.98 |
| DIN/DEN | 0.15 | 0.90 |
| DIN/DHT | 0.25 | 0.92 |

Figure 3A:
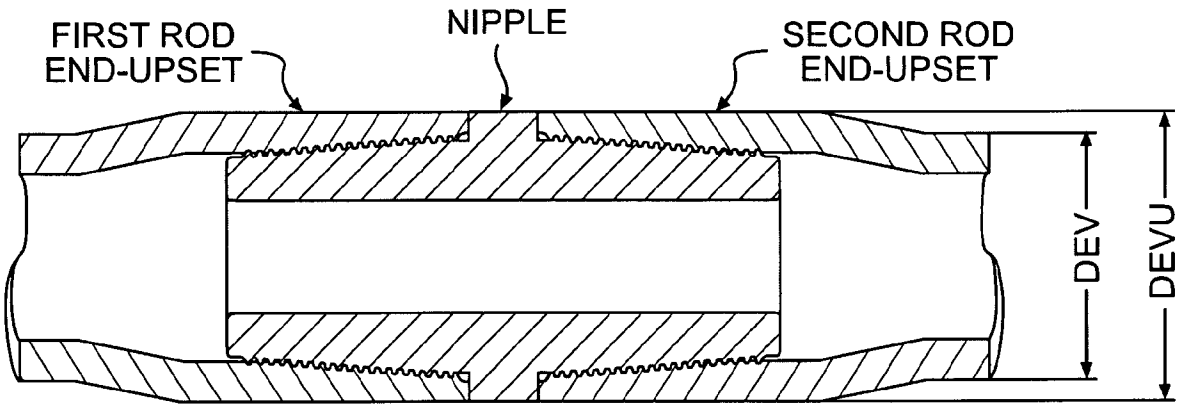
FIG. 3A represents a general configuration of the assembly of a Hollow Sucker Rod having first and second female threaded ends and a Nipple Connecting Element according to a second embodiment of the invention, with an upset end, or an enlarged outer diameter.
Figure 7A:
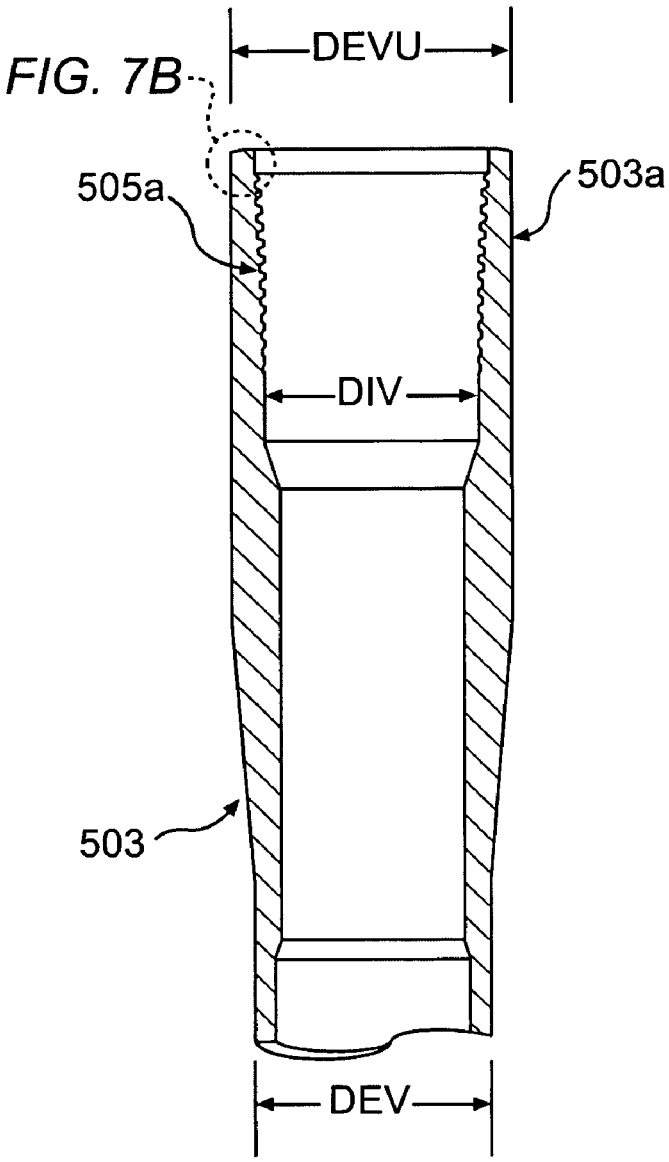
FIGS. 7A and 7B respectively represent an axial section view and a shoulder detail view of a Hollow Sucker Rod having a first female threaded end, according to the fifth embodiment of the invention.
Figure 9A:
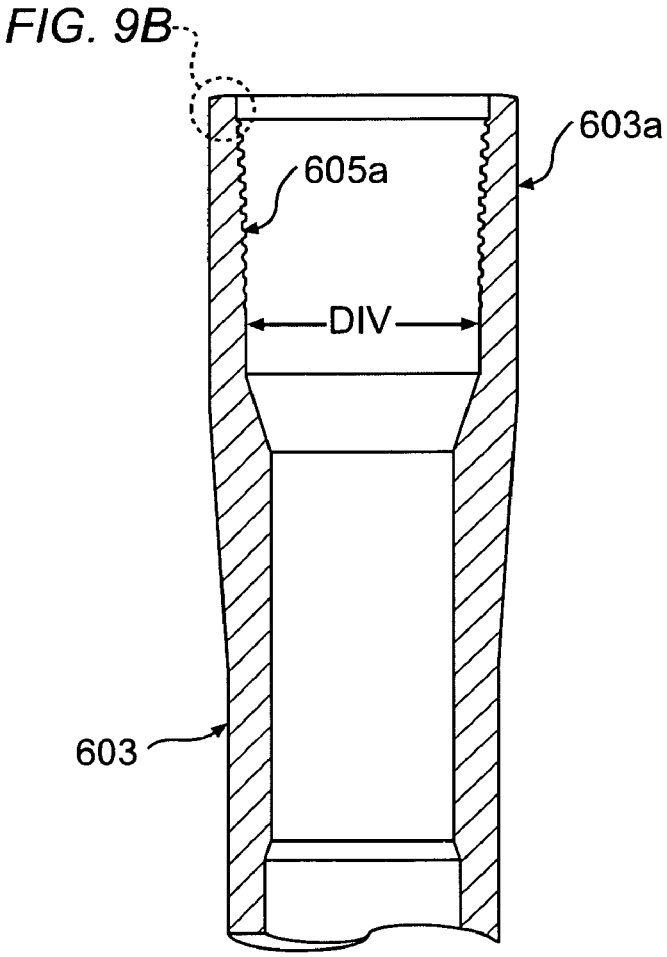
FIGS. 9A and 9B respectively represent an axial section view and a shoulder detail view of a Hollow Sucker Rod having a first female threaded end, that is upset, according to the sixth embodiment of the invention.

FIG. 2B also illustrates, by the broken line, a conical bore option, Option A, for the nipple inner bore configuration, which is preferred. FIG. 2A shows the hollow rod in the union zone with an outside diameter (DEVU) and an internal diameter of the rod at the extreme surfaces of the first and second ends corresponding to the end of the thread (DIFR). It also shows the outside diameter of the hollow rod (DEV) labeled as DEVU=DEV, because there is no upset end acting as the union. The ratio of the maximum external diameter (DEVU), either of a separate connector element or the upset type end of integral connector element union, to the external diameter of the rod (DEV), as illustrated at FIGS. 3A, 7A and 9A, is maintained within the following range:

$$1 \leq \frac{DEVU}{DEV} \leq 1.5$$

Hence for a maximum fixed diameter, the mean polar momentum of the hollow rod and connector string is greater than that for a solid pump rod of equal cross section diameter. Transmitted rotation moment or torque is therefore greater in a hollow rod column than in a solid rod column. This is also a determining factor in the resistance to the "backspin" phenomenon or counter-rotation of the rod string. Additionally, the ratio between the starting diameter of the torque shoulder on the connecting element (DHT) and the internal diameter of the hollow rod at the thread free end (DIFR), is maintained, as follows:

$$1 \leq \frac{DIFR}{DHT} \leq 1.1$$

Figure 3B:
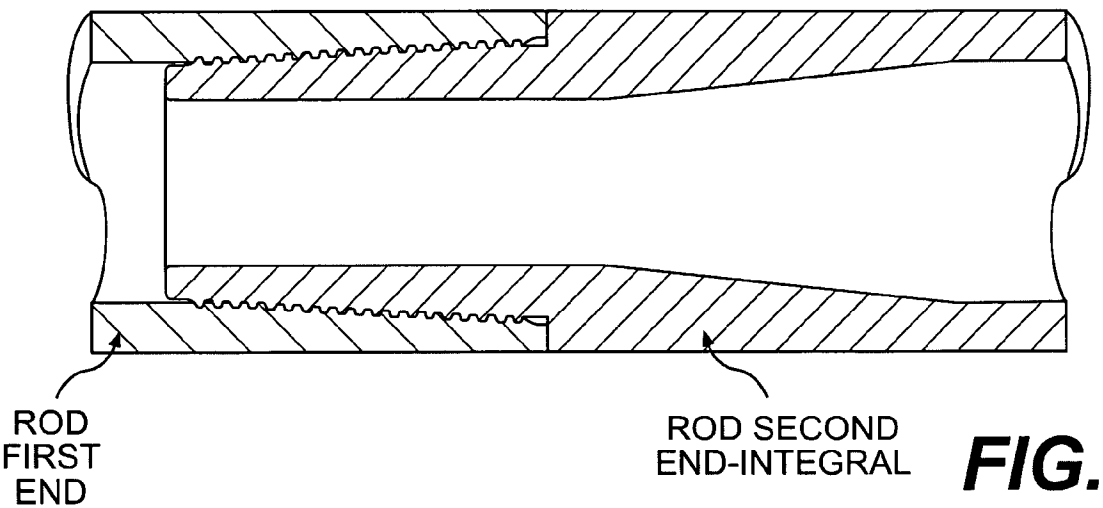
FIG. 3B represents a general configuration of the assembly of a Hollow Sucker Rod having a first female threaded end and a second end with a male threaded end according to a third embodiment of the invention, with a constant outer diameter.

FIG. 3A gives further references at the assembly in which the ratio of the maximum diameter of the union (DEVU) to the diameter of the body of the rod (DEV) is limited ($1<DEVU/DEV \leqq 1.5$). FIG. 3B is a possible configuration of the invention in which the female thread is machined on an upset first end of the rod, while the opposite or second end is machined with a corresponding male thread, the two threads being complementary but differential in diametral taper to each other. This configuration will be referred to as an upset rod, or as an integral union version.

FIGS. 4-10, inclusive, relate to preferred embodiments where a Hollow Sucker Rod comprises at least a first end of a tubular element threaded with a conical female thread which is configured as a Modified Buttress or SEC thread and which vanishes on the inside of the tubular element, in combination with a torque shoulder angle (Beta) of between 75° and 90°. The external diameter of the tubular element away from the ends being either 42 mm or 48.8 mm and the external diameter of the tubular element in the upset end, if present, being either 50 or 60.6 mm.

FIGS. 4A, 4B and 4C respectively represent an axial section view, a shoulder detail view and a cross-section view along Line 4C-4C of a Nipple Connecting Element 402 with a flat 406 having first and second male threaded ends, 401. and 401.*b*, according to a fourth embodiment of the invention, styled Hollow Rod 48x6 External Flush. In FIG. 4A the values are a Modified SEC thread 405.*b*, 8 threads per inch; DEN=48.8 mm; DIN=20 mm with an expansion to 26 mm over a length of 44 mm to the extreme end; DHT=39 mm; Beta=83°; overall length=158 mm; thread length=46 mm and central section length=50 mm. The shoulder detail 402.*a* in FIG. 4B begins 4.61 mm after the thread, has an inner radius of 1.4 mm and an outer shoulder radius of 0.5 mm.

FIGS. 5A and 5B respectively represent an axial section view and a shoulder detail view of a Hollow Sucker Rod 403 having a first female threaded end 403.*a*, according to the fourth embodiment of the invention. In FIG. 5A the values are a Modified SEC thread 405.*a*, 8 threads per inch; DEV=48.8 mm; DIFR=41.4 mm; DIV=37 mm; Beta=83°. The shoulder detail 404.*a* in FIG. 5B has a 30° transition at the thread and extends 4.5 mm; has an inner radius of 0.8 mm and an outer shoulder radius of 0.5 mm.

Figure 6A:
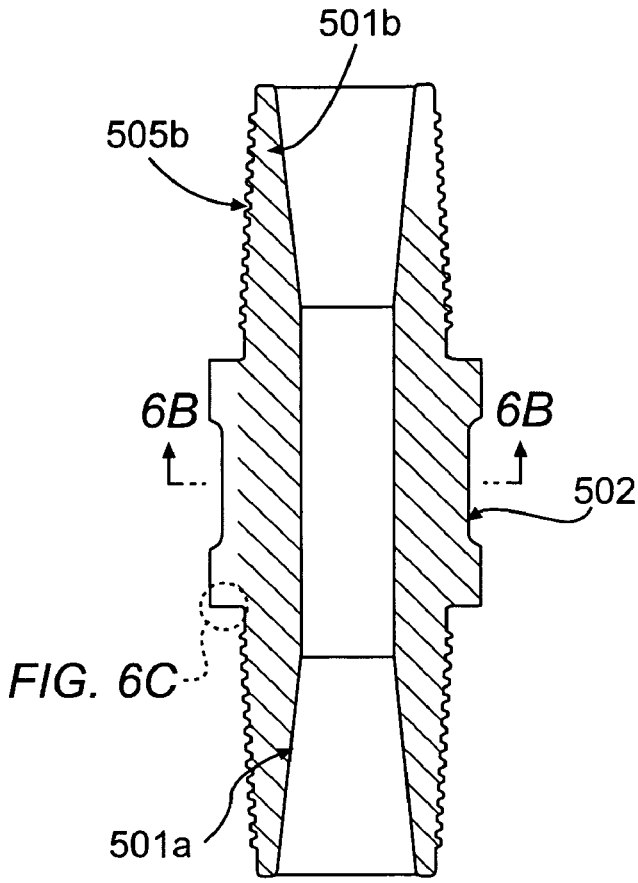
FIGS. 6A, 6B and 6C respectively represent an axial section view, a cross-section view along Line 6B-6B and a shoulder detail view of a Nipple Connecting Element having first and second male threaded ends, according to a fifth embodiment of the invention, styled Hollow Rod 42x5 External Upset.
Figure 6B:
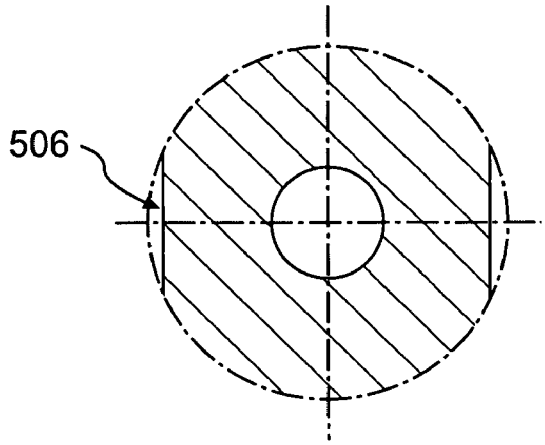
Figure 6C:
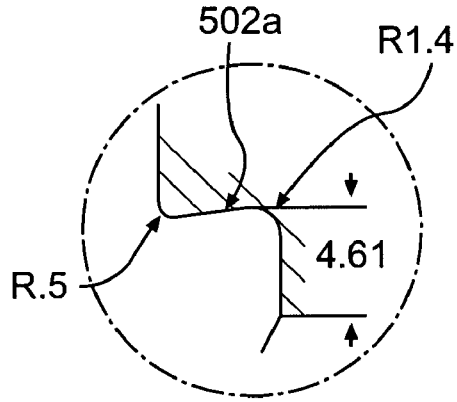

FIGS. 6A, 6B and 6C respectively represent an axial section view, a cross-section view along Line 6B-6B and a shoulder detail view of a Nipple Connecting Element 502 with flat 506 and having first and second male threaded ends, 501.*a* and 501.*b*, according to a fifth embodiment of the invention, styled Hollow Rod 42x5 External Upset. In FIG. 6A the values are a Modified SEC thread 505.*b*, 8 threads per inch; DEN=50 mm; DIN=17 mm with an expansion to 25.3 mm over a length of 44 mm to the extreme end; DHT=38.6 mm; Beta=83°; overall length=158 mm; thread length=46 mm and central section length=50 mm. The shoulder detail 502.*a* in FIG. 6C begins 4.61 mm after the thread, has an inner radius of 1.4 mm and an outer shoulder radius of 0.5 mm.

Figure 7B:
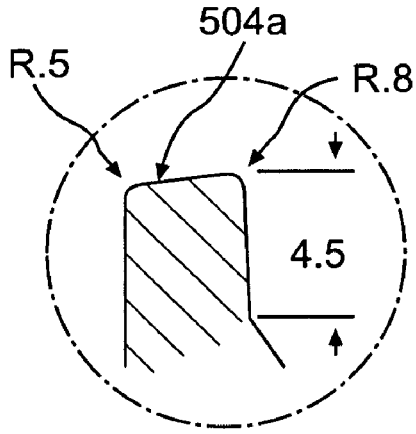

FIGS. 7A and 7B respectively represent an axial section view and a shoulder detail view of a Hollow Sucker Rod 503 having a first female threaded end 503.*a*, according to the fifth embodiment of the invention. In FIG. 7A the values are a Modified SEC thread 505.*a*, 8 threads per inch; DEVU ranging from 50 mm to DEV=42 mm; DIFR=41 mm; DIV=36.4 mm with a transition at 15° to 30 mm starting at 55 mm from the free end and back to 32 mm over a maximum length of 150 mm; Beta=83°. The shoulder detail 504.*a* in FIG. 7B has a 30° transition at the thread and extends 4.5 mm; has an inner radius of 0.8 mm and an outer shoulder radius of 0.5 mm.

Figure 8A:
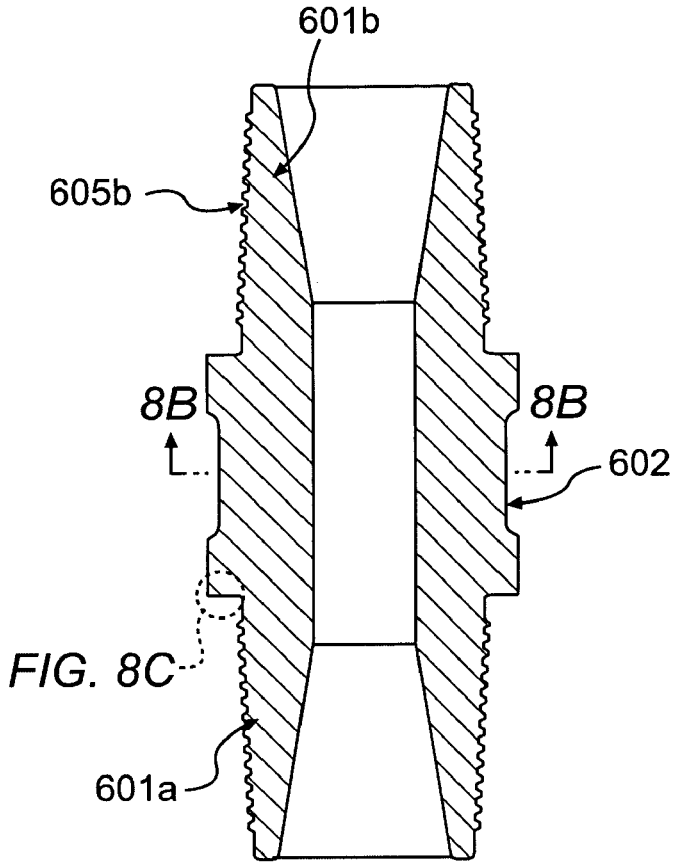
FIGS. 8A, 8B and 8C respectively represent an axial section view, a shoulder detail view and a cross-section view along Line 8B-8B of a Nipple Connecting Element having first and second male threaded ends, according to a sixth embodiment of the invention, styled Hollow Rod 48.8x6 External Upset.
Figure 8B:
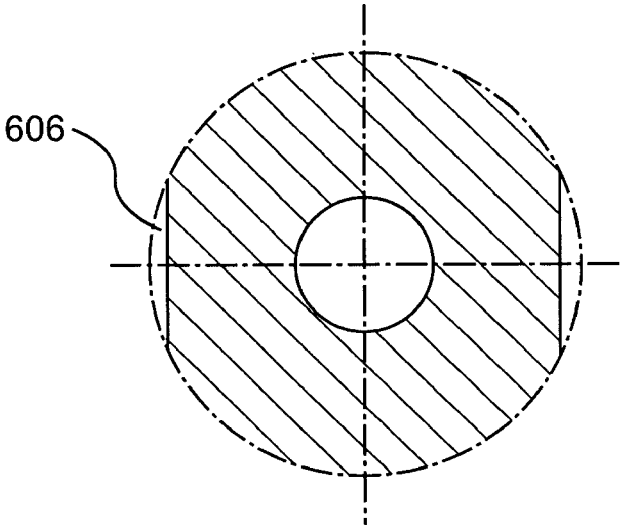
Figure 8C:
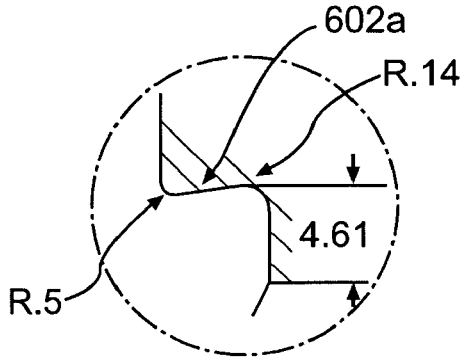

FIGS. 8A, 8B and 8C respectively represent an axial section view, a shoulder detail view and a cross-section view along Line 8B-8B of a Nipple Connecting Element 602 with flat 606 and having first and second male threaded ends, 601.*a* and 601.*b*, according to a sixth embodiment of the invention, styled Hollow Rod 48.8x6 External Upset. In FIG. 8A the values are a Modified SEC thread 605.*b*, 8 threads per inch; DEN=60.6 mm; DIN=20 mm with an expansion to 33.6 mm over a length of 44 mm to the extreme end; DHT=47 mm; Beta=83°; overall length=158 mm; thread length=46 mm and central section length=50 mm. The shoulder detail 602.*a* in FIG. 8C begins 4.61 mm after the thread, has an inner radius of 1.4 mm and an outer shoulder radius of 0.5 mm.

Figure 9B:
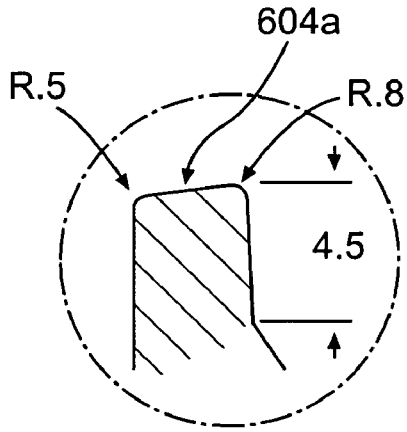

FIGS. 9A and 9B respectively represent an axial section view and a shoulder detail view of a Hollow Sucker Rod 603 having a first female threaded end 603.*a*, according to the sixth embodiment of the invention. In FIG. 9A the values are a Modified SEC thread 605.*a*, 8 threads per inch; DEVU ranging from 60.6 mm to DEV=48.8 mm; DIFR=49.4 mm; DIV=44.6 mm with a transition at 15° to 30 mm starting at 55 mm from the free end and back to 35.4 mm over a maximum length of 150 mm; Beta=83°. The shoulder detail 604.*a* in FIG. 9B has a 30° transition at the thread and extends 4.5 mm; has an inner radius of 0.8 mm and an outer shoulder radius of 0.5 mm.

Figure 10A:
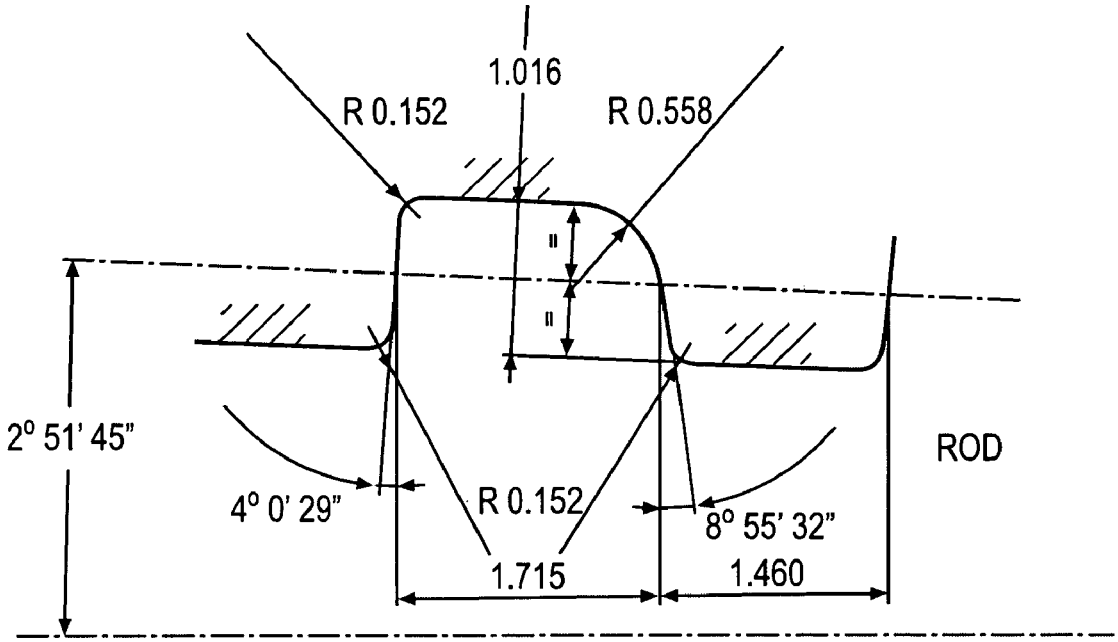
FIG. 10A represents an axial section view and dimension detail view of a first female threaded end on a Hollow Sucker Rod showing the configuration of a trapezoidal, non-symmetric thread profile that is a Modified Buttress or SEC thread, according to the preferred embodiments of the invention.

FIG. 10A represents an axial section view and dimension detail view of a first female threaded end on a Hollow Sucker Rod showing the configuration of a trapezoidal, non-symmetric thread profile that is a Modified Buttress or SEC thread, according to the rod first end preferred embodiment. The female thread shape of each Hollow Sucker Rod is trapezoidal and non-symmetric and is incomplete. The thread pitch is 8 threads per inch. The thread height is 1.016+0/−0.051 mm. The Diametrical taper in the threaded section is 0.1 mm/mm. The Length of threads on at least the first end of the tubular element is 44 mm., with part of the threads being incomplete due to vanishing of thread on the inside of the tubular element. The thread taper angle is 2° 51' 45"; the tooth inner surface is 1.46 mm and the teeth spacing is 1.715 mm; the leading edge has a 4° taper or load flank angle and an inner radius of 0.152 mm while the trailing edge has a 8° taper and a larger inner radius of 0.558 mm. At the end of the threaded section a short cylindrical section on the inside of the threaded area transitions the threaded area to the bore of the hollow tubular element.

Figure 10B:
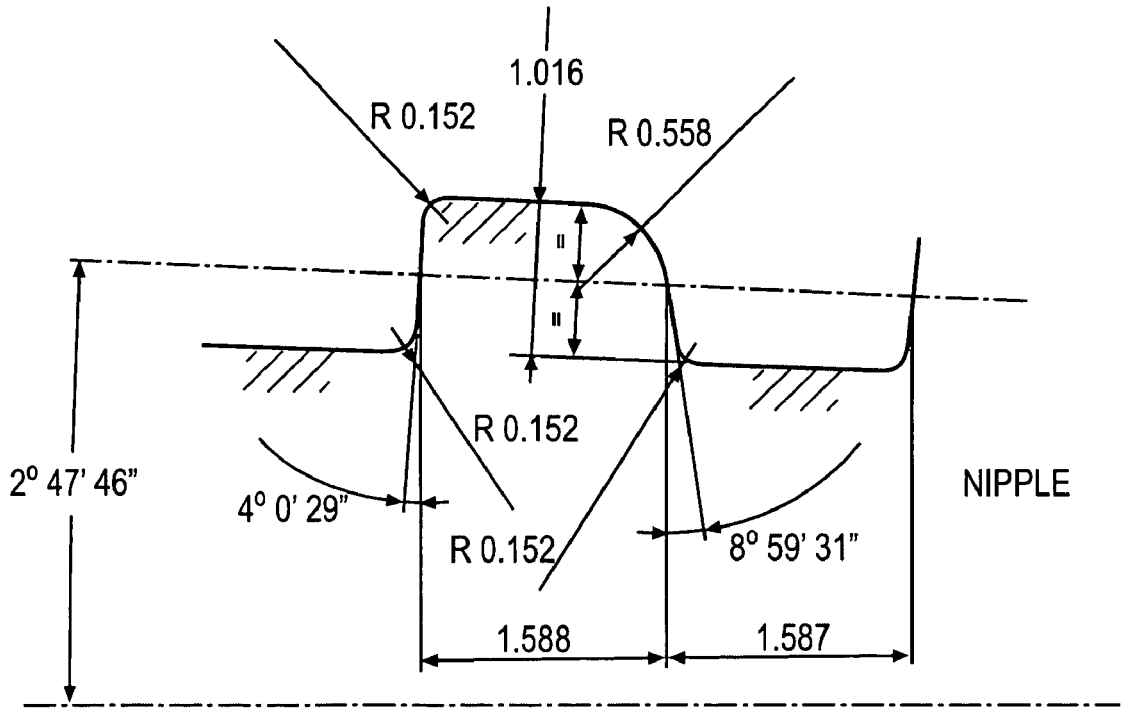
FIG. 10B represents an axial section view and dimension detail view of a first male threaded end on a Nipple Connecting Element showing the configuration of a trapezoidal, non-symmetric thread profile that is a Modified Buttress or SEC thread, according to the preferred embodiments of the invention.

FIG. 10B represents an axial section view and dimension detail view of a first male threaded end on a Nipple Connecting Element showing the configuration of a trapezoidal, non-symmetric thread profile that is a Modified Buttress or SEC thread, according to the nipple first or second end preferred embodiment. The external diameter of the central section of each Nipple Connecting Element is 50 mm or 60.6 mm and the central section can present a pair of machined diametrically opposite flat surfaces, to be engaged by a wrench during connection make up. The male thread is a Modified Buttress thread and is complete across both ends of the nipple. The threaded section pitch is 8 threads per inch. The thread height lies between 1.016+0.051/−0 mm. The diametrical thread taper in the threaded area is 0.0976 mm/mm. The thread shape is trapezoidal and non-symmetric. The length of threads on each extreme of the nipple is 46 mm. All threads on the nipple are complete. The angle of the conical surface in the torque shoulder (Beta) is 83°. The radius at the tips of the torque shoulder is 1.4 mm for the internal radius and 0.5 mm for the external radius. There are preferred conical bores under each threaded section of the nipple, which are connected by a cylindrical bore. The thread taper angle is 2° 47' 46"; the tooth inner surface is 1.587 mm and the teeth spacing is 1.588 mm; the trailing edge has a 4° taper or load flank angle and an outer radius of 0.152 mm while the leading edge has a 8° taper and a larger outer radius of 0.558 mm.

Figure 11:
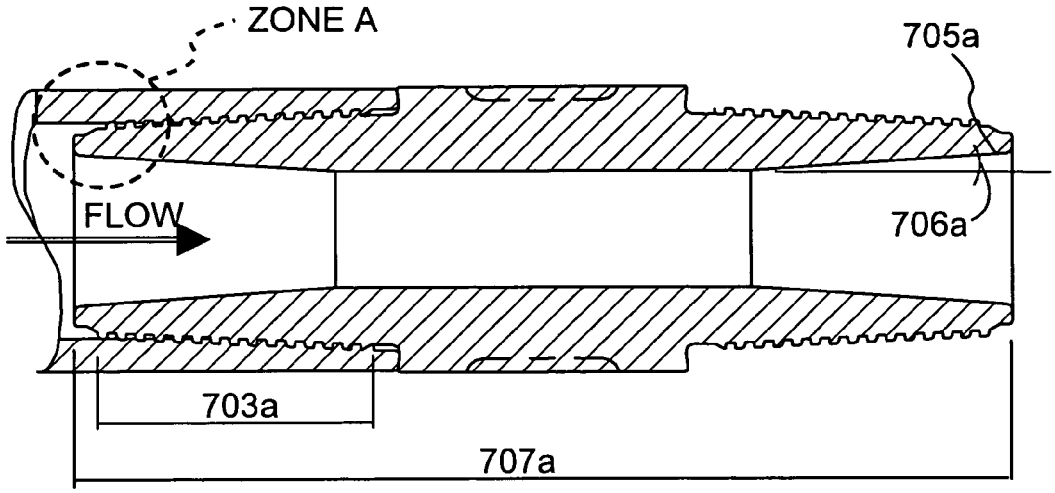
FIG. 11 illustrates an axial section view of an external flush joint, with Zone A indicating a stagnation zone.
Figure 12:
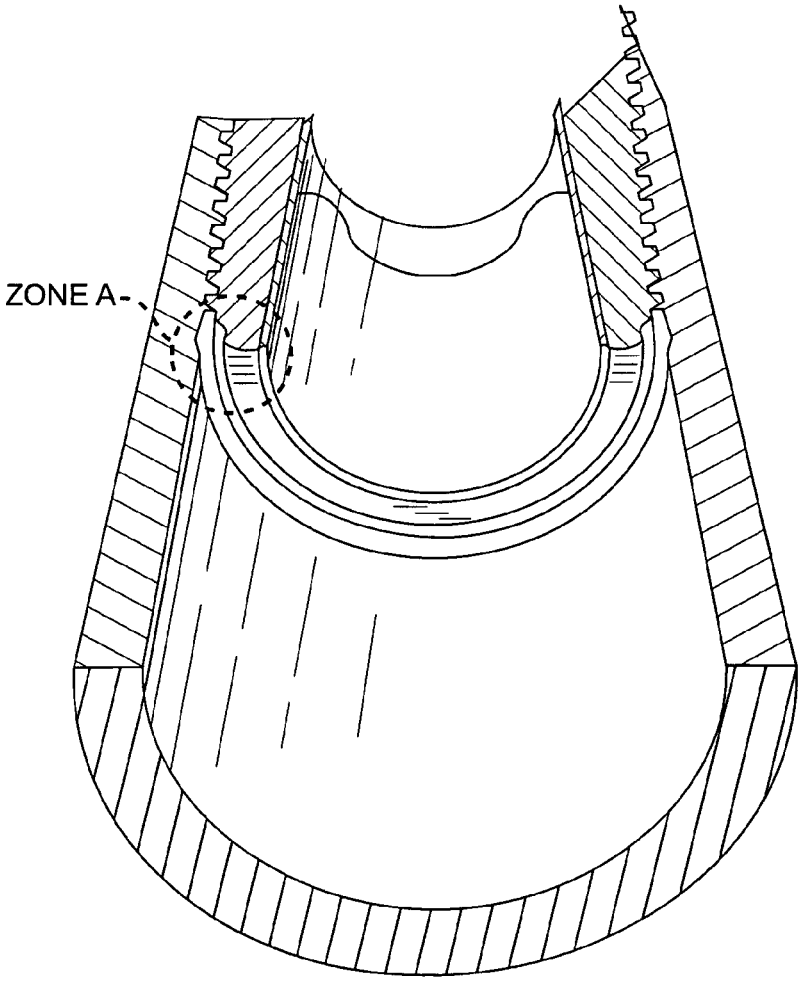
FIG. 12 illustrates corrosion in a stagnation zone.

FIGS. 11 and 12 illustrate the corrosion problem when a fluid flows through the interior of the rod with reasonable speed. Early wear of the nipple and rod occurs in the area where they connect (overlap). This phenomenon can be attributed to the existence of an "stagnation area" where the fluids remains almost still (low velocity). See Zone A, in FIGS. 11 and 12.

Figure 13:
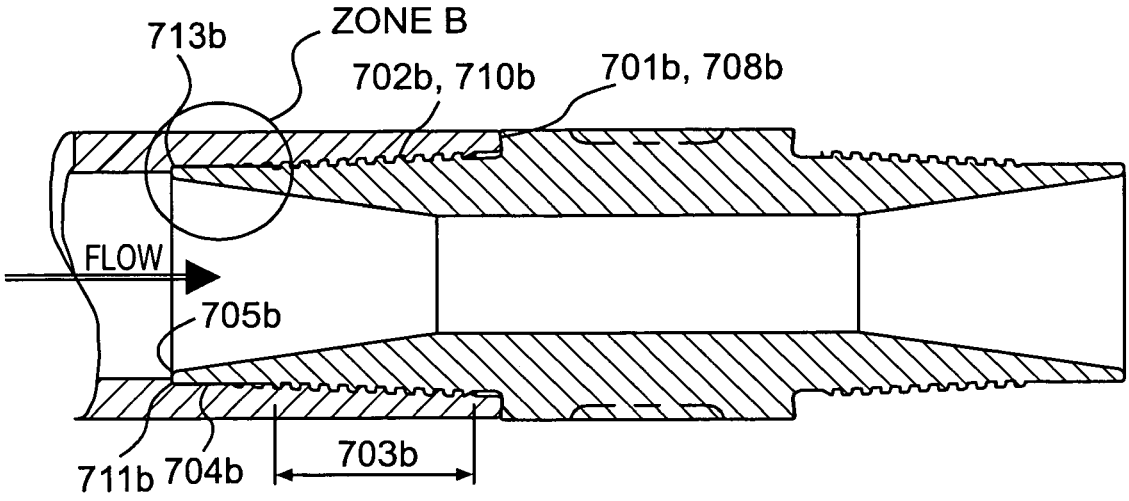
FIG. 13 illustrates an axial section view of a modified external flush joint, with a modified nipple, according to a seventh embodiment of the invention.
Figure 14:
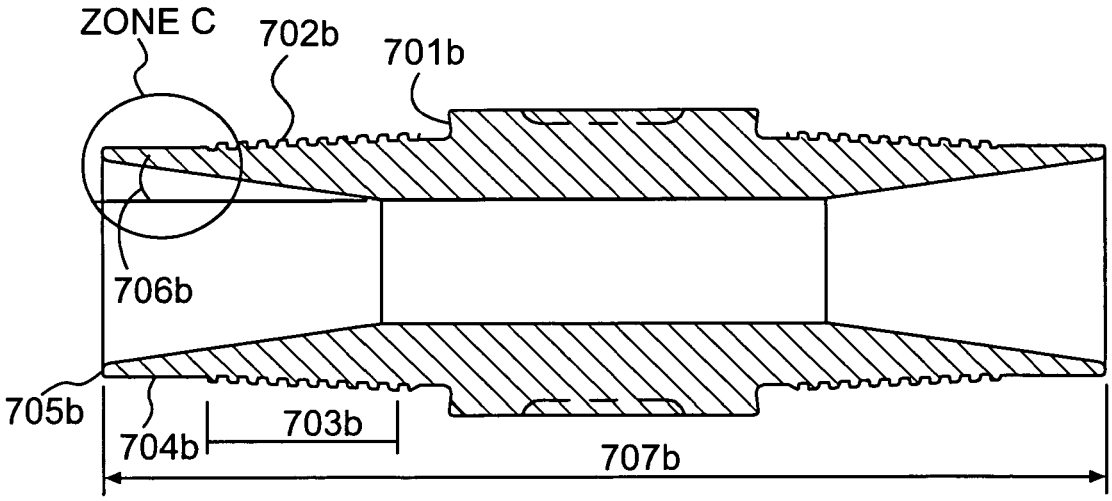
FIG. 14 illustrates an axial section view of a modified nipple, as in FIG. 13.
Figure 15:
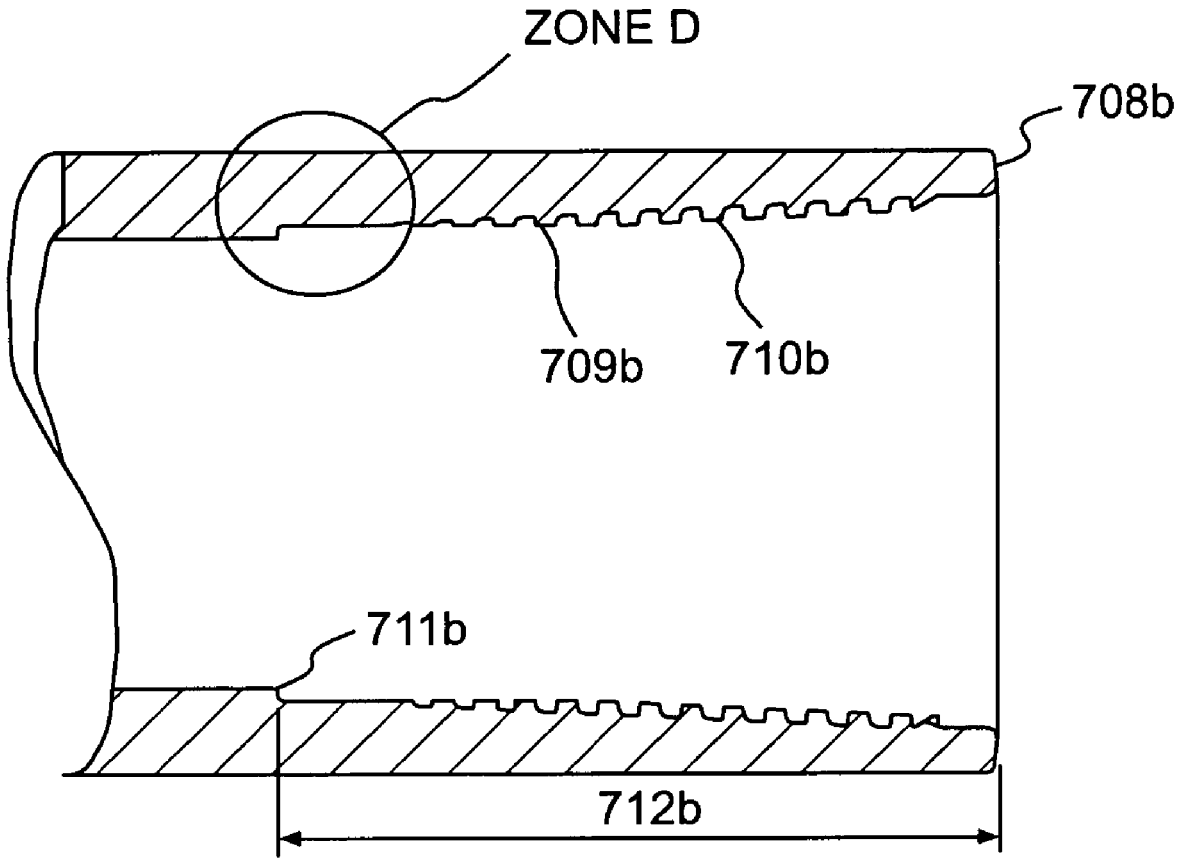
FIG. 15 illustrates an axial section view of a modified rod, as in FIG. 13.

To solve the above mentioned problem the nipple and rod of the type shown in FIGS. 2A and 2B were modified. FIG. 11 illustrates such a hollow rod 48x6, external flush, with a stagnation area at Zone A and the resulting corrosion illustrated in a photographic section view, by FIG. 12. A small seal was introduced at the ends of the nipple, with the corresponding modification of the angle of the internal conical bore (Zone B, C and D in FIG. 13-15). With this modification the "stagnation zone" does not exist any more and the fluid flows smoothly and with little turbulence. It is important to note that these modifications are small so that they do not alter significantly the stress distribution in the connection, nor the performance of the product. Note that the illustrated modifications were done on the nipple and the rod (FIGS. 13-15). FIG. 13 represents a slight variation of FIG. 11. A modification is introduced to the existing Nipple, in terms of a small seal zone, in order to prevent the fluid (when flowing through the inside of the pipe) to remain in the "stagnation area" promoting erosion-corrosion.

The stress distribution on the nipple and rod are similar to the HR 48x6 External Flush illustrated by FIGS. 2A-2C and FIG. 11.

The torque shoulder (701*b*, FIGS. 13-14) is similar to that in FIG. 11.

The nominal diameter and diametrical taper in the threaded section (702*b*, FIGS. 13-14) are likewise similar to FIG. 11.

The nipple threads are complete and the length of threads (703*b*, FIG. 13-14) is smaller, and different than shown in FIG. 11. (703*a*, FIG. 11).

There is an external cylindrical zone between the end of the nipple and the threaded section (704*b*, FIGS. 13-14). The length is between 10 mm to 27 mm and the external diameter is 36.8 mm. This is different from FIG. 11.

The end of the nipple works as a seal of the union (705*b*, FIGS. 13-14). The thickness of the end of the nipple is 2 mm, which is different from FIG. 11. (705*a*, FIG. 11).

The bore of the nipple is conical in the extremes. The preferred angle is 8° 16' (706*b*, FIG. 14) and is different from FIG. 11. (3° 46'; See 706*a*, FIG. 11)

The total length of the nipple (707*b*, FIG. 14) is similar to FIG. 11. (707*a*, FIG. 11)

The rod likewise has a torque shoulder (708*b*, FIGS. 13 and 15). The dimensions of that shoulder are similar to the shoulder shown in FIG. 11. Part of the threads on the pipe or rod end is incomplete due to vanishing of thread on inside of pipe (709*b*, FIG. 15), which is similar to FIG. 11. The nominal diameter and diametrical taper in the threaded section (710*b*, FIGS. 13 and 15) are similar to FIG. 11.

There is a seal inside of the rod, near the end of incomplete threads on the rod (711*b*, FIGS. 13 and 15). While that seal may appear to be a second torque shoulder, it does not function as one, and has not been designed to sustain load. The thickness of the seal is between 0 to 1.7 mm and depends on the manufacturing tolerances of the pipe, and is different from the HR 48x6 External Flush version of FIG. 11. The angle of seal inside of the rod is 90 degrees and the length of it from the end of the pipe is 55 mm (711*b* and 712*b*, FIGS. 13 and 15), which is different from FIG. 11. After "make up" (service torque applied), the separation between the nipple and the rod) at Zone B ranges from about 0 to 0.6 mm (713*b*, FIG. 13). The seal Zone B is lightly loaded and it does not transmit torque. It is used only as a seal and to promote a smooth flowing of the fluid.

FIGS. 16-18 illustrate another embodiment, where the objective is to substantially increase the flow of fluid extracted, through a further modification to the extreme ends of a hollow sucker rod string, of the type illustrated at FIGS. 2A-2C, FIG. 11 or FIG. 13.

A series of holes were drilled in the rod's body at the two extremes (ground level and well bottom level) of the string. In this way, the fluid is allowed to flow also (usually it does through the annular region between the outer surface of the rod and the inner surface of the "tubing") through the interior of the Hollow Rod. The holes pattern preferably may be a Configuration 1 with 2 holes per transverse section, alternating at 90°, with a given longitudinal distance between sections (FIGS. 16A, 16B); a Configuration 2 with holes that follow an helicoidal path with a "separation"in the longitudinal direction, and angle between holes of different sections (FIGS. 17A, 17B); or a Configuration 3: Three holes per transverse section with a given longitudinal distance (FIGS. 18A, 18B).

Figure 16A:
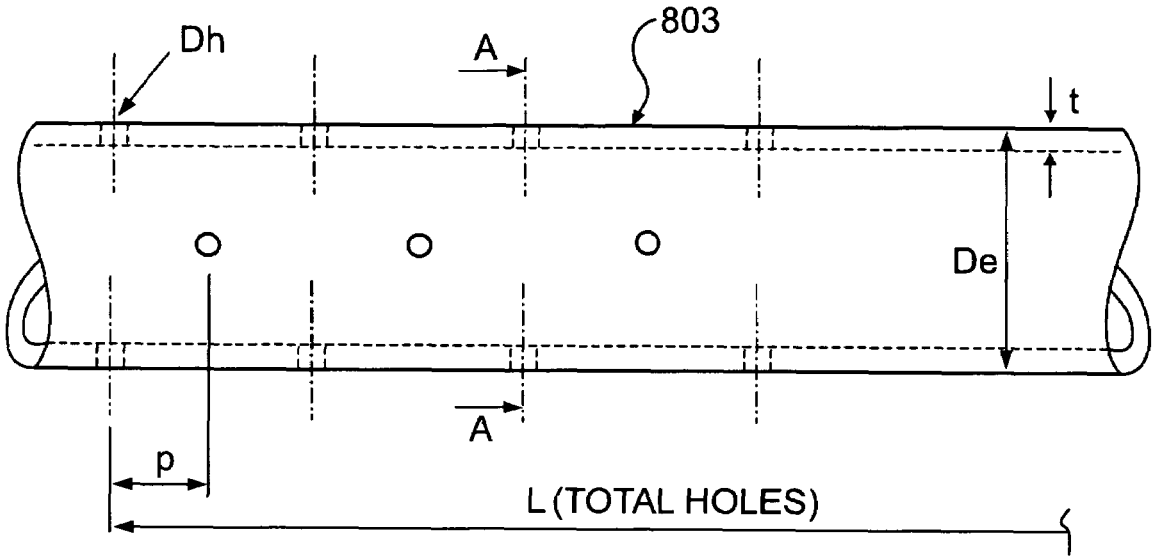
FIGS. 16A and 16B illustrate an axial and section view of one extreme end of a modified rod, according to a Configuration 1.
Figure 16B:
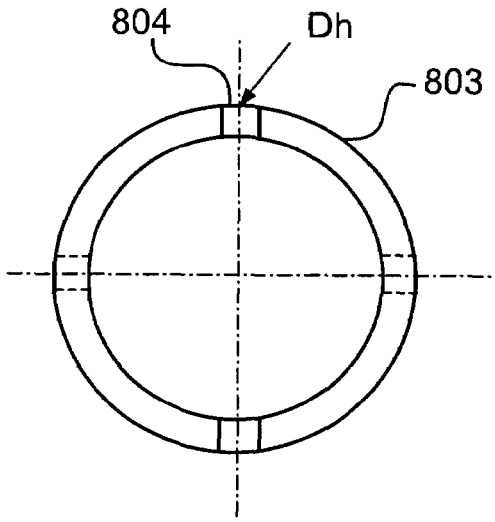

FIGS. 16A, B illustrate one extreme end of hollow rod 803 with 2 holes, 804, per transverse section, 180° apart, distributed in an alternate way, each set opposed at 90° to the adjacent set of holes with a given distance between sections, p (FIGS. 16A and 16B). The preferred hole diameter, Dh, is between 5 mm to 7 mm. The preferred longitudinal distance between sections, p, is between 50 to 100 mm. The preferred total (longitudinal) length of the zone at each extreme end that has such holes, L, is 3000 mm to 4000 mm, with the zone comprising between 62 to 162 holes.

Figure 17A:
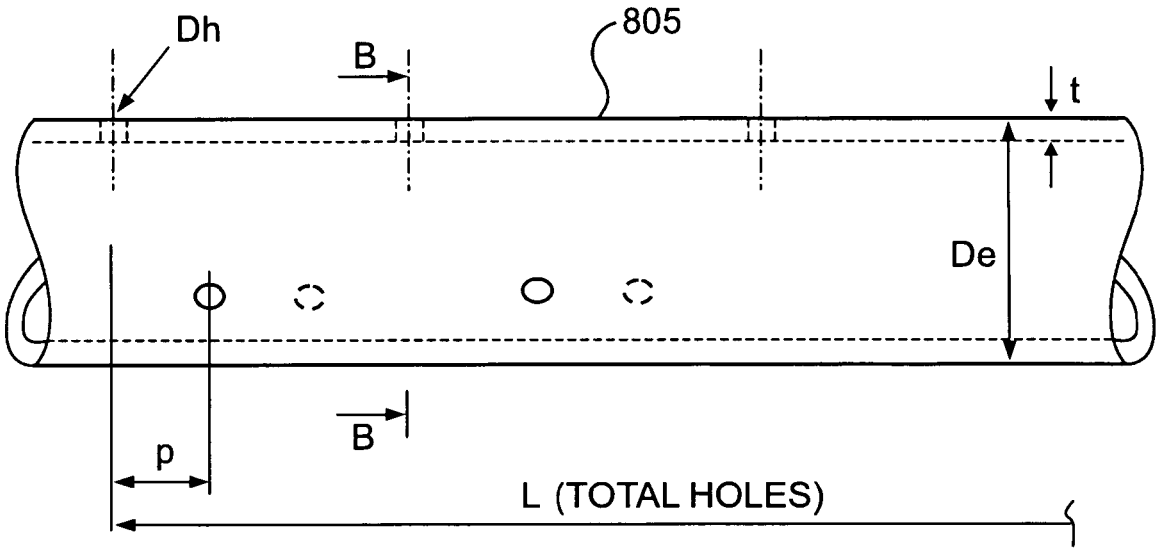
FIGS. 17A and 17B illustrate an axial and section view of one extreme end of a modified rod, according to a Configuration 2.
Figure 17B:
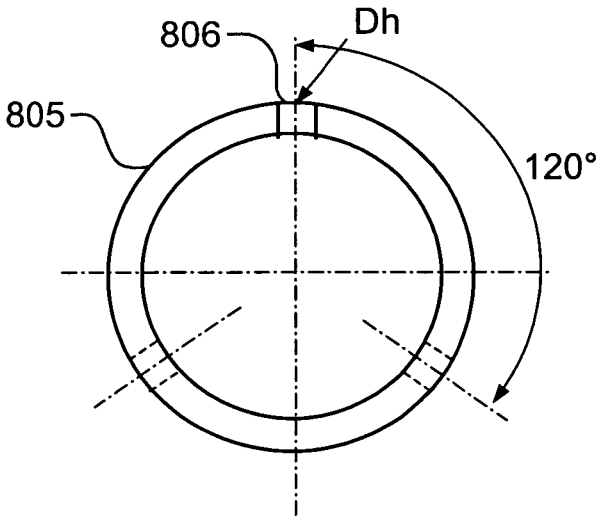

FIGS. 17A, B illustrate one extreme end of hollow rod 805 with 1 hole, 806, per transverse section. The holes follow a helicoidal path, with a preferred longitudinal separation or pitch, p (FIG. 17B), and a rotation angle from one section to the following of 120°. (FIGS. 17A and 17B). The preferred hole diameter, Dh, is between 5 mm and 7 mm. The preferred longitudinal distance between sections, p, is between 25 to 50 mm. The preferred total (longitudinal) length of the zone at each extreme end that has such holes, L, is 3000 mm to 4000 mm, with the zone comprising between 61 to 161 holes.

Figure 18A:
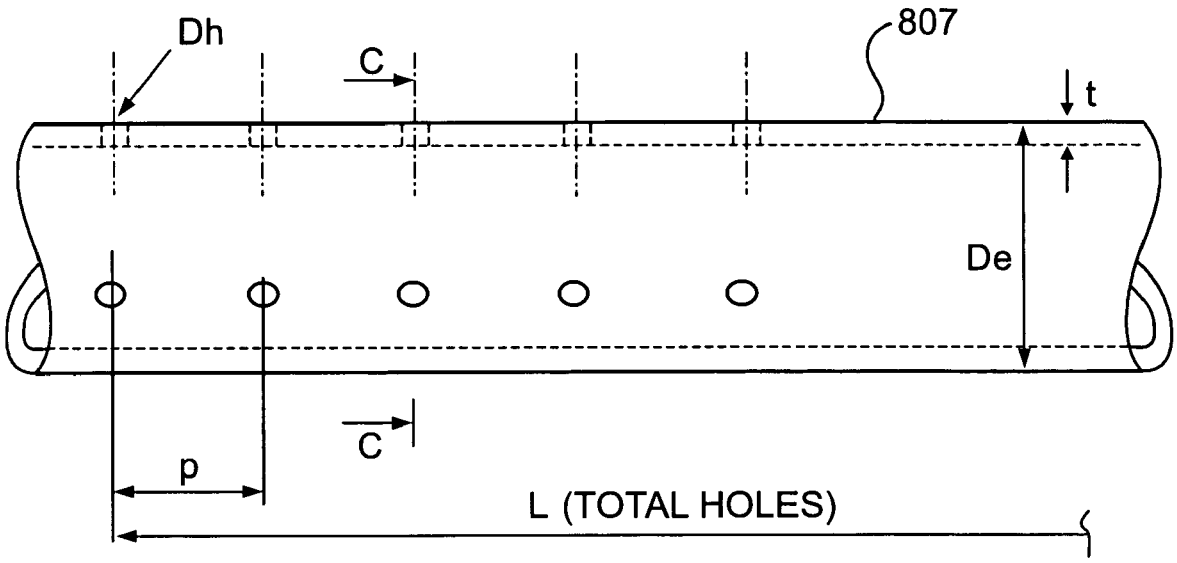
FIGS. 18A and 18B illustrate an axial and section view of one extreme end of a modified rod, according to a Configuration 3.
Figure 18B:
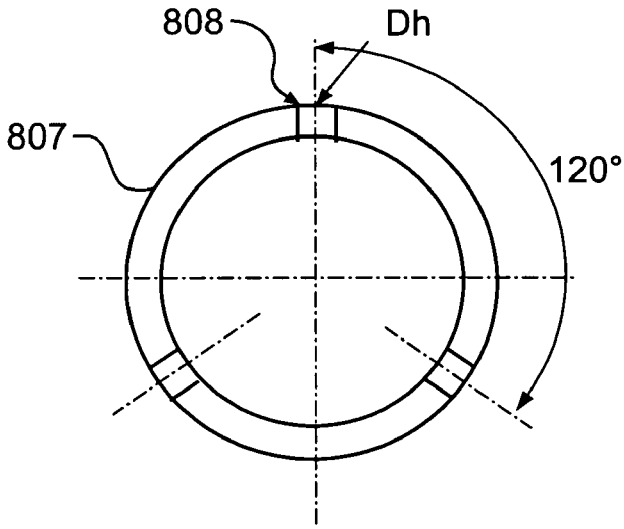

FIGS. 18A,B illustrate one extreme end of hollow rod 807 with 3 holes, 808, per transverse section, each about 120° apart about the circumference, with a preferred longitudinal separation or pitch, p (FIG. 18B). The preferred hole diameter, Dh, is between 5 mm and 7 mm. The preferred longitudinal distance between sections, p, is between 50 to 100 mm. The preferred total (longitudinal) length of the zone at each extreme end that has such holes, L, is 3000 mm to 4000 mm, with the zone comprising between 93 to 243 holes.

Therefore, the Modified Nipple (with seal) of FIG. 13 produces smooth fluid flow and little turbulence, when a fluid flows though the inside of the pipe, in turn yielding good erosion-corrosion resistance at Zone B when fluid flows though the inside of the pipe. The nipple of FIG. 14 also is interchangeable with a nipple as in FIG. 11.

Hence, for all preferred embodiments, there is a diametral or differential taper. For example the rod first end taper is 0.1 inches/inch, while the corresponding taper of the either nipple end is 0.0976 inches/inch. For all preferred embodiments, the angle of the conical surface in the torque shoulder (Beta) is preferably 83°. The radiuses at the tips of the torque shoulder are 0.8 mm for the internal radius and 0.5 mm for the external radius.

Likewise, for all preferred embodiments, the Connecting Element has a central section that is externally cylindrical. Close to the outer diameter of this central section external torque shoulders are located to mate with the torque shoulder on a first end of a Hollow Sucker Rod. Both extremes of a nipple are conical and externally threaded, and a conical inner bore proximate the length of each threaded extreme creates an advantageous combination of structure, to ensure an increasing cross-section of the nipple from each free end of the nipple towards the central section, and the torque shoulder locations.

The main dimensions with respect to the invention illustrated by the eighth and ninth embodiments characterized by two sets of torque shoulders have those dimensions and references illustrated in FIGS. 19-23. Those dimensions as well dimensions for an intermediate size that is not illustrated [Hollow Rod 42x5 Exter. Upset, with DEVU=50.0 mm] are summarized in the following Table, as follows:

| DEVU & DEN (mm) | DIN1 (mm) | DHT1 (mm) | DIN2 (mm) | DHT2 (mm) | α (°) | DEV (mm) | DIV (mm) | DIFR1 (mm) | DIVU (mm) | DIFR2 (mm) |
|---|---|---|---|---|---|---|---|---|---|---|
| 48.8 | 20.0 | 39.0 | 26.0 | 34.3 | 3° 54' | 48.8 | 35.4 | 41.7 | 26.0 | 35.2 |
| 50.0 | 17.0 | 38.6 | 26.0 | 33.7 | 5° 50' | 42.2 | 32.2 | 41.0 | 26.0 | 34.6 |
| 60.6 | 20.0 | 47.0 | 34.0 | 41.9 | 9° 7' | 48.8 | 35.4 | 49.4 | 34.0 | 42.8 |

Figure 19:
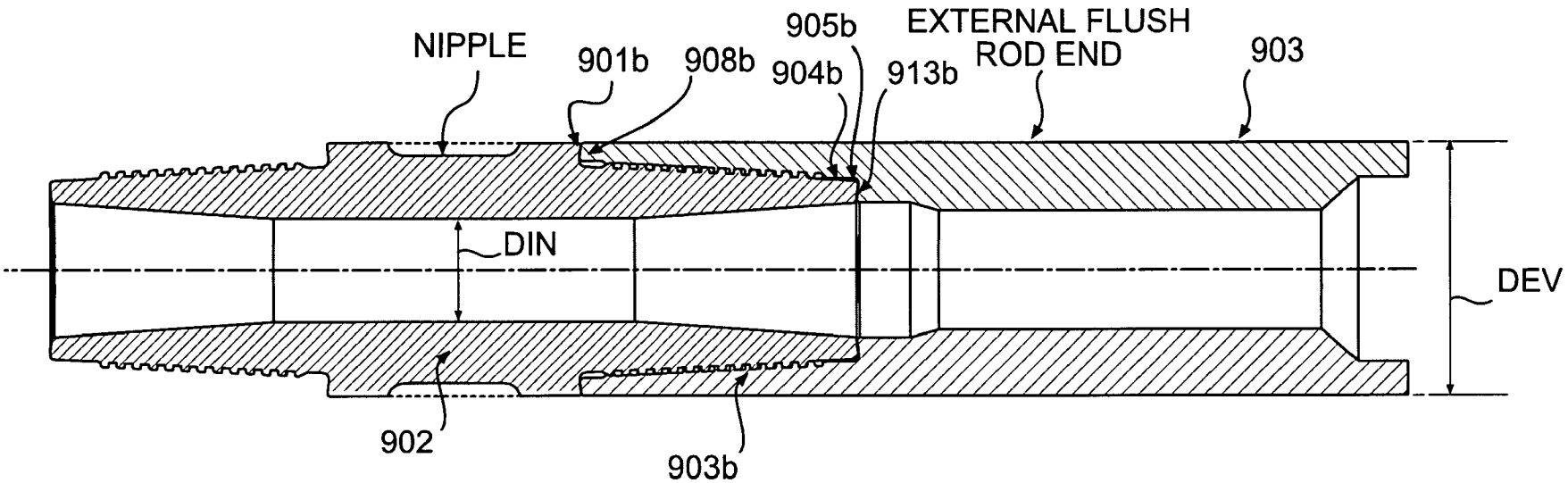
FIG. 19 illustrates an axial section view of a modified external flush joint, with a modified nipple and external flush rod end characterized by two torque shoulders, according to an eighth embodiment of the invention, styled Hollow Rod 48x6 External Flush with two torque shoulders.

FIGS. 19-23, inclusive, relate to two torque shoulder embodiments where a Hollow Sucker Rod comprises at least a first end of a tubular element threaded with a conical female thread which is configured as a Modified Buttress or SEC thread and which vanishes on the inside of the tubular element. A cylindrical zone 904*b* on the nipple is between the end and the threads, and is about 9.5 mm long and 34.3 in diameter, as shown in FIG. 19, in combination with a first pair of torque shoulders, 901*b*, 908*b*, and a second pair of torque shoulders 905*b*, 913*b*, wherein each set of shoulders are inclined at about 7° to a line perpendicular to the connector centerline, or an angle (Beta) of about 83°. The external diameter or DEVU and DEN of the tubular element away from the ends in the eight and ninth embodiments is 48.8 mm and the external diameter of the tubular element in the upset end, if present, is about 60.6 mm. The material used must have a Yield Stress ≧960 MPa (139.2 Ksi) and Ultimate Tensile Stress ≧1015 MPa (147.2 Ksi). The connection has diametrical interference between the two mating threaded sections on the rod and the nipple. When hand-tightened, the clearance between the first torque shoulders of rod and nipple are in the range c1=0.4–2.5 mm and the clearance between the second torque shoulders of rod and nipple are in the range, c1=0.4–2.8 mm, wherein c2≧c1 and 0 mm≦(c2–c1)≦0.3 mm. The second torque shoulder in the eighth and ninth embodiments therefore is moderately loaded and transmits torque, while also serving as a seal to promote smooth flow, as in the seventh embodiment (FIG. 13).

Figure 20A:
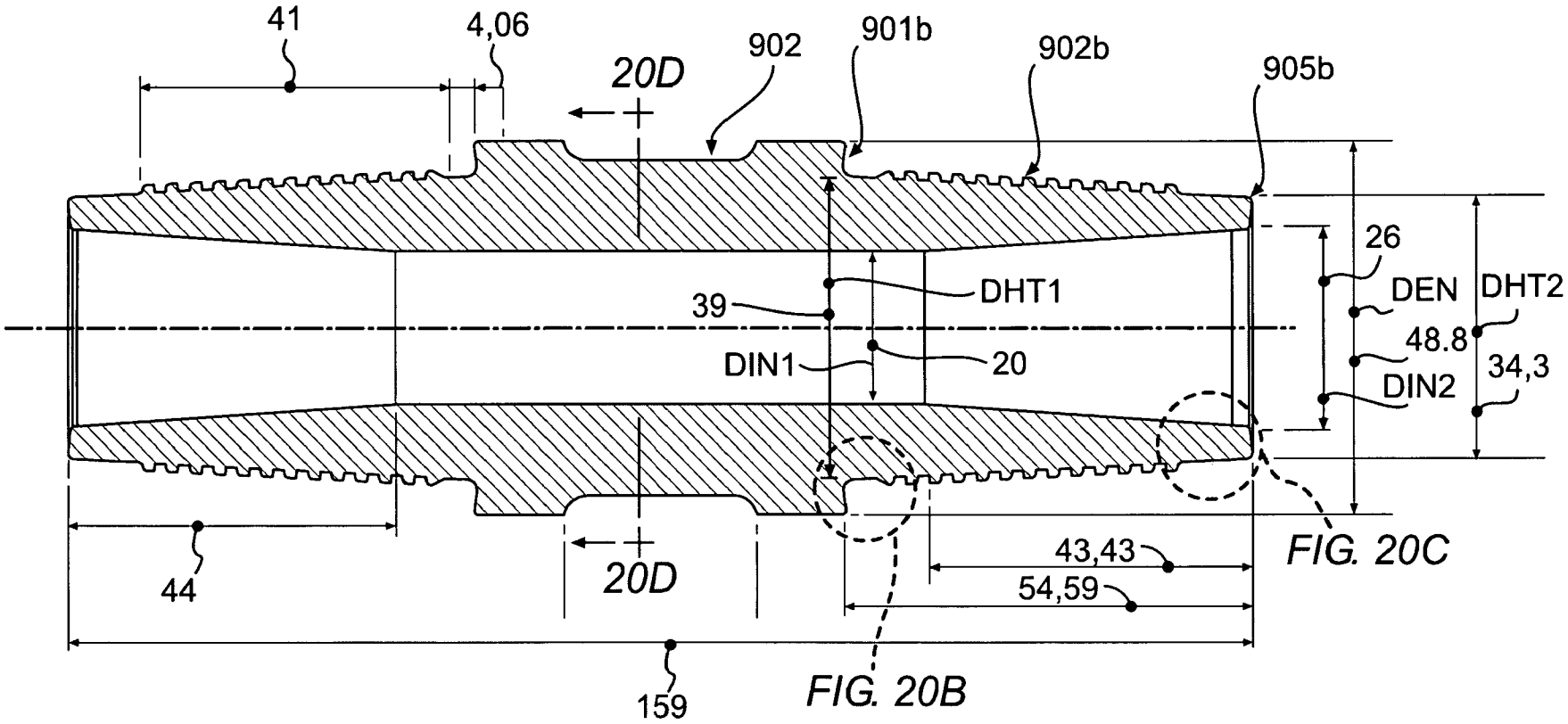
FIG. 20A illustrates an axial section view of the modified nipple of FIG. 19, and FIGS. 20B, 20C and 20D respectively represent a first nipple torque shoulder detail view, a second nipple torque shoulder detail view and a cross-section view along Line 20D-20D of a Nipple Connecting Element having first and second male threaded ends, according to the eighth embodiment of the invention.
Figure 20D:
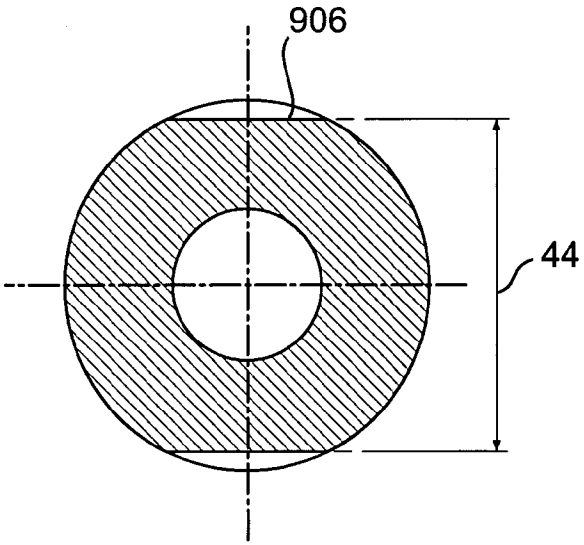
Figure 20C:
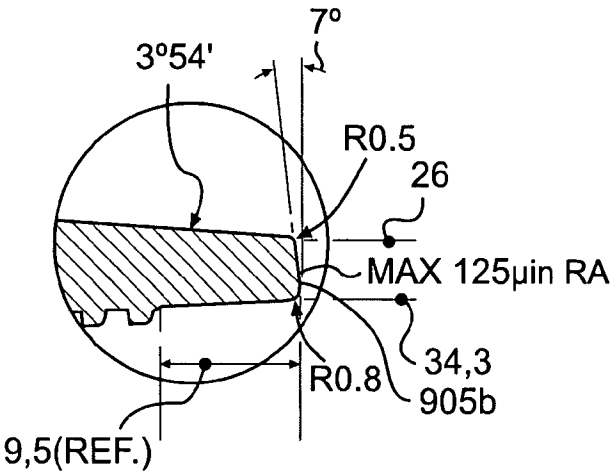

FIGS. 20A, 20B, 20C and 20D respectively represent an axial section view, a first shoulder detail view, a second shoulder detail view and a cross-section view along Line 20D-20D of a Nipple Connecting Element 902 with a flat 906 having first and second male threaded ends, according to an eighth embodiment of the invention, styled Hollow Rod 48x6 External Flush with two torque shoulders. In FIG. 20A the values of a Modified SEC thread 902.*b*, are 8 threads per inch; DEN=48.8 mm; DIN1=20 mm with an expansion to 26 mm over a length of 44 mm to the extreme end; DIN2=26 mm; DHT1=39 mm; DHT2=34.3 mm; the overall nipple length=159 mm; thread length=41 mm; and a length between the shoulders of 54.59 mm. For the eighth embodiment, the dimension ratios are DHT1/DEN=0.80; DIN1/DEN=0.41; DIN1/DHT1=0.513; DEVU/DEV=1.0; DIFR1/DHT1=1.062; DIFR1/DEVU=0.85; DIVU/DIFR2=0.74; DIN2/DHT2=0.76; DEVU/DIVU=0.53; DIFR2/DEVU=0.72; and DIN1/DIN2=0.77.

Figure 20B:
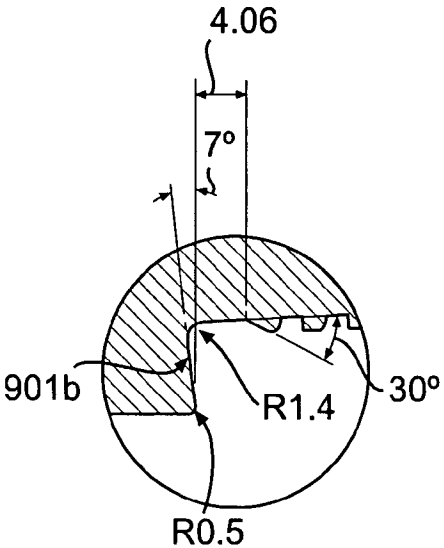

The first nipple shoulder 901*b* further detailed in FIG. 20B begins 4.06 mm after an external thread with a 30° inclined trailing surface, has a Beta=83°, has an inner radius of 1.4 mm and an outer shoulder radius of 0.5 mm. The second nipple shoulder 905*b* detailed in FIG. 20C begins 9.5 mm ahead of a first external thread, has a Beta=83°, an inner radius of 0.5 mm at a diameter point of 26 mm and an outer shoulder radius of 0.8 mm. at a diameter point of 34.3 mm. The surface has a maximum 125 μin RA value, and α=3° 54'.

Figure 21A:
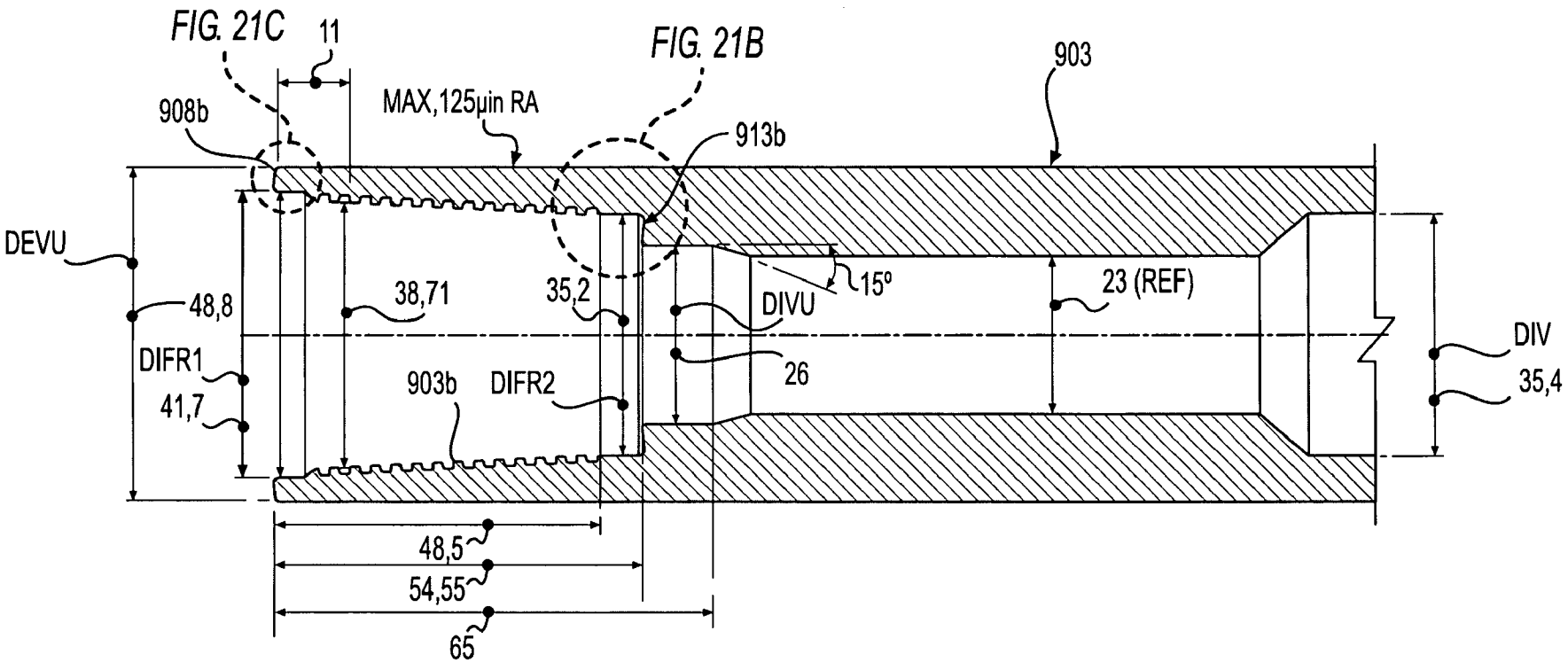
FIG. 21A illustrates an axial section view of the modified external flush rod of FIG. 19, and FIGS. 21B and 21C respectively represent a second rod torque shoulder detail view and a first rod torque shoulder detail view according to the eighth embodiment of the invention.
Figure 21B:
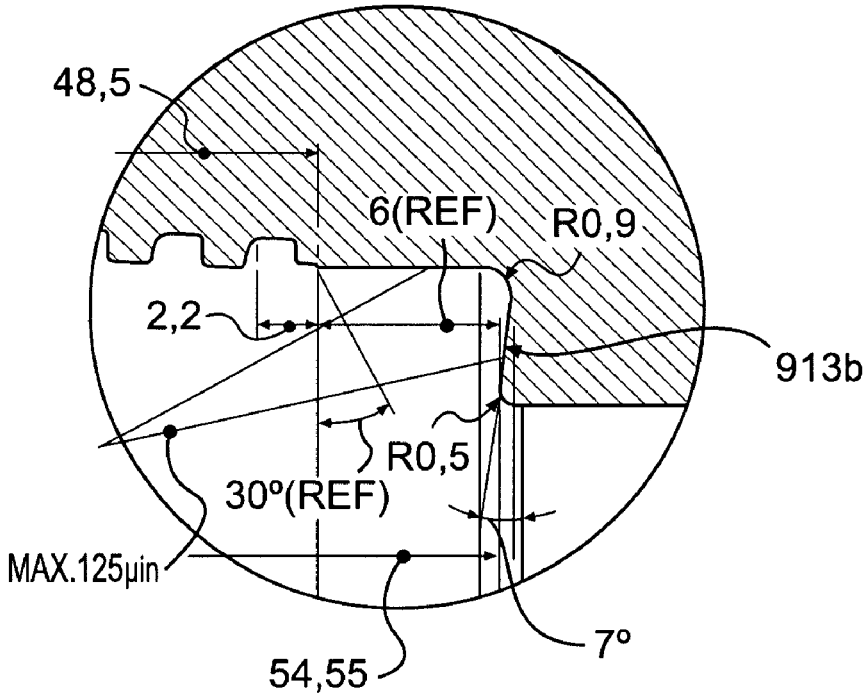
Figure 21C:
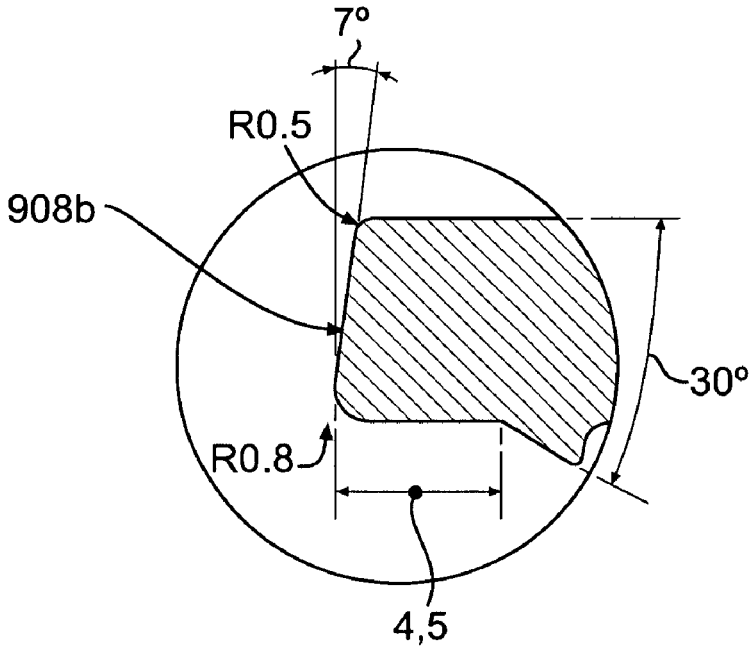

FIGS. 21A, 21B and 21C respectively represent an axial section view and a shoulder detail view of an external flush Hollow Sucker Rod 903 with a first female threaded end 903*b*, a second rod shoulder 913*b* detail view, and a first rod shoulder 908*b* detail view according to the eighth embodiment of the invention. DEVU=48.8 mm; DIFR1=41.7 mm; DIFR2=35.2 mm; DIVU=26 mm; DIV=35.4 mm; and the rod inner bore=23 mm.

The second rod shoulder 913*b* detailed in FIG. 21B begins 6 mm after an internal thread, has a Beta=83°, has an inner radius of 0.5 mm at a DIVU diameter point of 26 mm. and an outer shoulder radius of 0.9 mm. at a diameter point of 35.2 mm. The surface has a maximum 125 μin RA value. The first rod shoulder 908*b* detailed in FIG. 21C begins 4.5 mm ahead of a first internal thread leading surface with a 30° inclined surface, has a Beta=83°, an outer radius of 0.5 mm at a diameter point of 48.8 mm and an inner shoulder radius of 0.8 mm. at a diameter point of 41.7 mm. The distance between the shoulders is 54.55 mm. according to the eighth embodiment of the invention.

FIGS. 22A, 22B, 22C and 22D respectively represent an axial section view, a first shoulder detail view, a second shoulder detail view and a cross-section view along Line 22D-22D of a Nipple Connecting Element 1002 with a flat 1006 having first and second male threaded ends, according to a ninth embodiment of the invention, styled Hollow Rod 48x6 Upset Rod End with two torque shoulders, having an external dimension or DEVU and DEN=60.6 mm. For the ninth embodiment, the dimension ratios are DHT1/DEN=0.776; DIN1/DEN=0.33; DIN1/DHT1=0.425; DEVU/DEV=1.24; DIFR1/DHT1=1.051; DIFR1/DEVU=0.82; DIVU/DIFR2=0.79; DIN2/DHT2=0.81; DEVU DIVU=0.56; DIFR2/DEVU=0.71; and DIN1/DIN2=0.59.

Figure 22A:
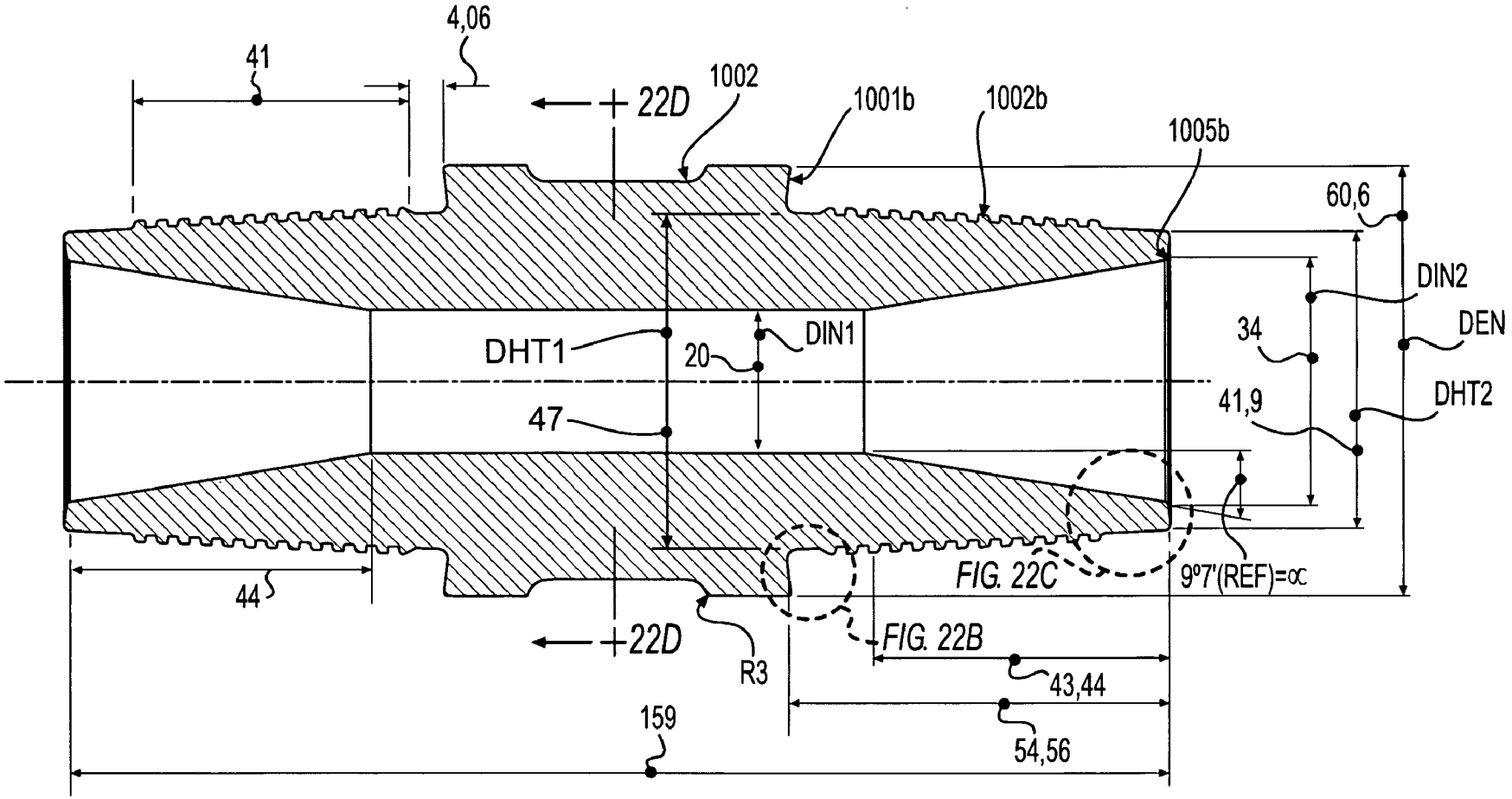
FIG. 22A illustrates an axial section view of a modified nipple according to a ninth embodiment of the invention, styled Hollow Rod 48x6 Upset Rod End with two torque shoulders, and FIGS. 22B, 22C and 22D respectively represent a first nipple torque shoulder detail view, a second nipple torque shoulder detail view and a cross-section view along Line 22D-22D of a Nipple Connecting Element having first and second male threaded ends, according to the ninth embodiment of the invention.

In FIG. 22A the values of a Modified SEC thread 1002*b*, are 8 threads per inch; DEN=60.6 mm; DIN1=20 mm with an expansion to 34 mm over a length of 44 mm to the extreme end; DIN1=20 mm; DHT1=47 mm; DIN2=34 mm; DHT2=41.9 mm; α=9° 7'; thread length=41 mm and an overall length=159 mm.; and a length between the shoulders of 54.56 mm.

Figure 22B:
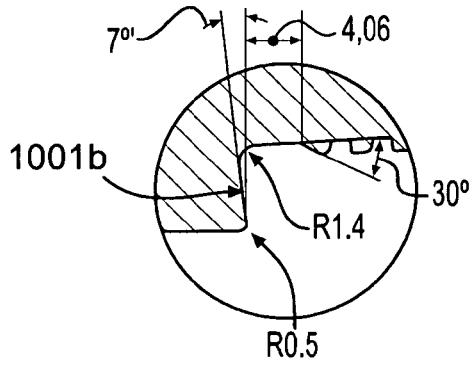
Figure 22C:
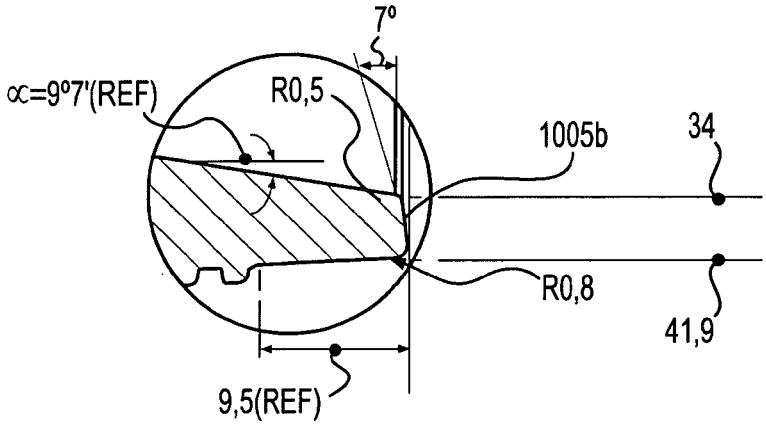
Figure 22D:
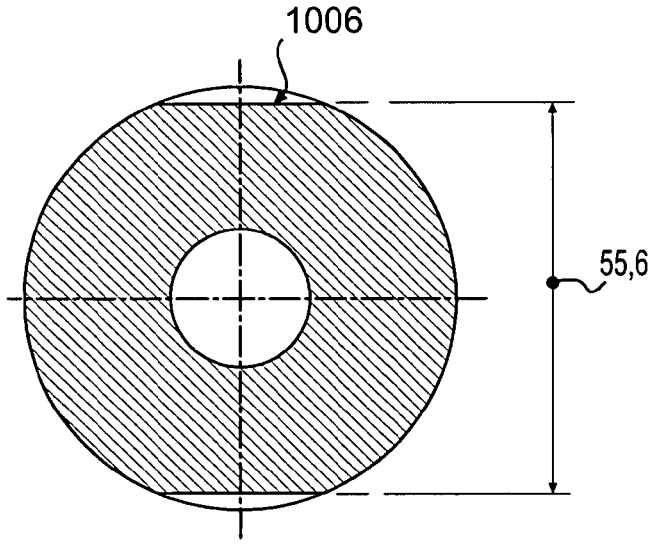

The first nipple shoulder 1001*b* detailed in FIG. 22B has a Beta=83°, begins 4.06 mm after an external thread with a 30° inclined trailing surface, has an inner radius of 1.4 mm and an outer shoulder radius of 0.5 mm. The second nipple shoulder 1005*b* detailed in FIG. 22C begins 9.5 mm ahead of a first external thread, has a Beta=83°; α=9° 7'; an inner radius of 0.5 mm at a diameter point of 34 mm and an outer shoulder radius of 0.8 mm. at a diameter point of 41.9 mm. The surface has a maximum 125 μin RA value.

Figure 23A:
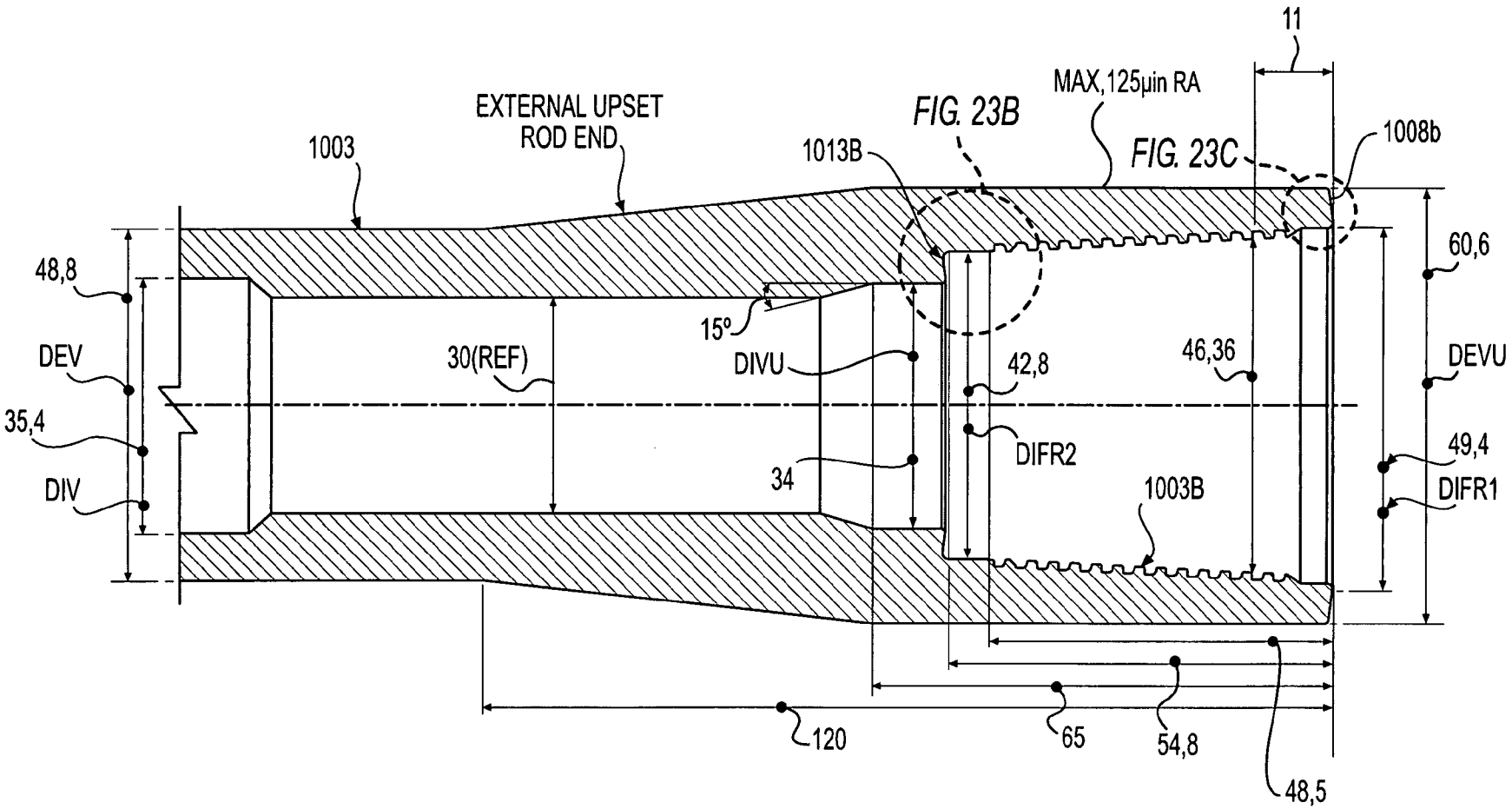
FIG. 23A illustrates an axial section view of a modified external upset rod end according to the ninth embodiment of the invention and FIGS. 23B and 23C respectively represent a rod second torque shoulder detail view and a rod first torque shoulder detail view according to the ninth embodiment of the invention.
Figure 23B:
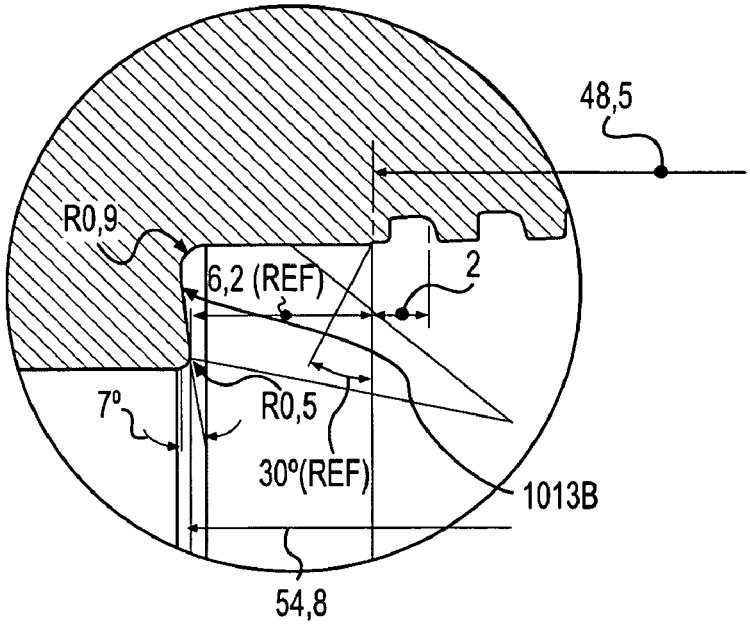
Figure 23C:
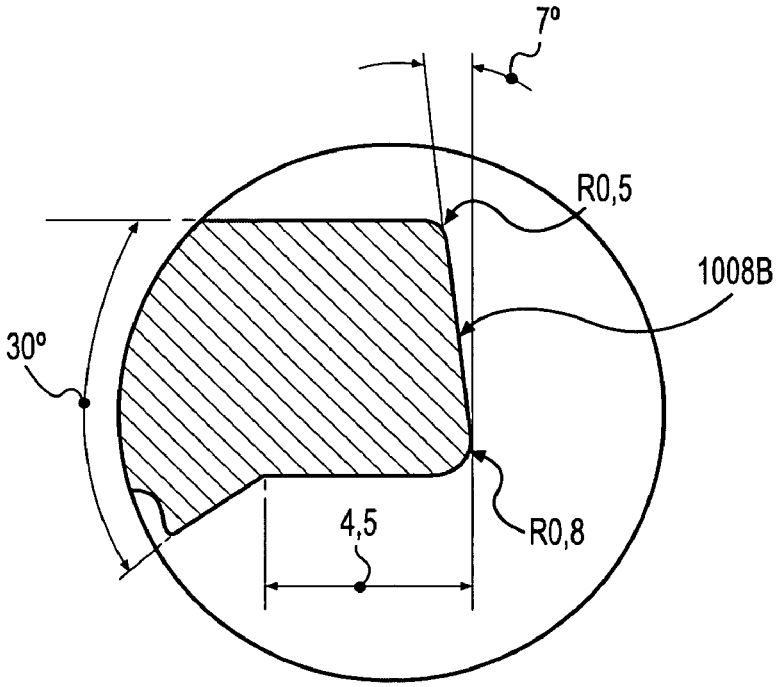

FIGS. 23A, 23B and 23C respectively represent an axial section view and a shoulder detail view of an upset end of Hollow Sucker Rod 1003 having a first female threaded end 1003*b*, a second rod shoulder 1013*b* detail view, and a first rod shoulder 1008*b* detail view according to the ninth embodiment of the invention. DEVU=60.6 mm; DIV=35.4 mm; DIVU=34 mm; DIFR1=49.4 mm; DIFR2=42.8 mm;

The second rod shoulder 1013*b* detailed in FIG. 23B begins 6.2 mm after an internal thread, has a Beta=83°, has an inner radius of 0.5 mm at a DIVU diameter point of 34 mm. and an outer shoulder radius of 0.9 mm. at a diameter point of 42.8 mm. The first rod shoulder detail 1008*b* in FIG. 23C begins 4.5 mm ahead of a first internal thread leading surface with a 30° inclined surface, has a Beta=83°, an outer radius of 0.5 mm at a DEVU diameter point of 60.6 mm and an inner shoulder radius of 0.8 mm. at a diameter point of 49.4 mm. The distance between the shoulders is 54.8 mm. according to the ninth embodiment of the invention. The surface has a maximum 125 μin RA value.

While preferred embodiments of our invention have been shown and described, the invention is to be solely limited by the scope of the appended claims.

We claim:

1. An elongated drive string assembly comprising a plurality of hollow sucker rods and connecting elements with an axis, connected together and between a drive head located at the surface of an oil well and a rotary pump located deep down hole in an oil well, wherein each hollow sucker rod has at least a first end comprising an internal female threaded surface engaging an external male threaded surface on a connecting element, wherein said threads are frustro-conical, non-symmetrical but differential in diametral taper to each other; the first end of each hollow sucker rod further comprising an annular torque shoulder engaging an annular torque shoulder on a connecting element, and being characterized in that, for an outside diameter of the connecting element (DEN), an internal diameter (DIN1) of the connecting element, and a diameter of the torque shoulder on the connecting element (DHT1), the following ratios are maintained:

| | Range | |
|---|---|---|
| Diameter Ratios | Min. | Max. |
| DHT1/DEN | 0.7 | 0.9 |
| DIN1/DEN | 0.2 | 0.6 |
| DIN1/DHT1 | 0.3 | 0.7. |

2. An elongated drive string assembly comprising a plurality of hollow sucker rods and connecting elements with an axis, connected together and between a drive head located at the surface of an oil well and a rotary pump located deep down the oil well, wherein at least one hollow sucker rod has a first end comprising an internal female threaded surface engaging an external male threaded surface on one of said connecting elements, wherein said threads are frusto-conical and non-symmetrical, but differential in diametral taper to each other; the first end of said at least one hollow sucker rod further comprising a first torque shoulder that is engaging a first torque shoulder on said one connecting element and being characterized in that, for an outside diameter of the connecting element (DEN), inner bore diameters (DIN1, DIN2) of the connecting element, a diameter of the first torque shoulder on the connecting element (DHT1) and a diameter of a second torque shoulder on the free end of the connecting element (DHT2), the following ratios are maintained:

| | Range | |
|---|---|---|
| Diameter Ratios | Min. | Max. |
| DHT1/DEN | 0.7 | 0.9 |
| DIN1/DEN | 0.20 | 0.60 |
| DIN1/DHT1 | 0.30 | 0.70 |
| DIN2/DHT2 | 0.67 | 0.92 |

wherein said one connector element is a separate nipple having said male threaded surface on a free end of said nipple and a central section defining said first torque shoulder, and said male threaded surface of said nipple free end comprising complete threads, said nipple free end further comprises a portion that is adapted to engage against an inner surface of the rod, so as to define said second torque shoulder.

3. An elongated drive string assembly according to claim 2, being further characterized in that the free end of said at least one rod is upset, and comprises an upset rod end maximum diameter (DEVU), an upset rod end inner diameter (DIVU), a rod internal diameter at the free end (DIFR1), the following ratios are maintained:

| | Range | |
|---|---|---|
| Diameter Ratios | Min. | Max. |
| DEVU/DIVU | 0.4 | 0.7 |
| DIFR1/DEVU | 0.75 | 0.95. |

4. An elongated drive string assembly according to claim 3, being further characterized in that, for an upset rod end inner diameter (DIVU) and a rod internal diameter at the thread inner end (DIFR2), the following ratio is maintained:

| | Range | |
|---|---|---|
| Diameter Ratios | Min. | Max. |
| DIVU/DIFR2 | 0.65 | 0.90. |

5. An elongated drive string assembly according to claim 2, wherein said nipple includes two free ends which comprise a male threaded surface comprising complete threads and an engaging portion which comprises an external cylindrical zone between each free end and the beginning of the male threaded surface on each free end, said zones further define a seal between an inner bore of the hollow rod and the complete threads on each nipple free end, which is proximate to said second torque shoulder.

6. An elongated drive string assembly according to claim 2, wherein the torque shoulders are conical and are disposed at an angle Beta of between 80° and 90° and the ratio of the inner bore diameters of the nipple, DIN1/DIN2, is between 0.4 and 1.00 and the ratio of an outer and inner bore diameter of an upset pipe end, DEVU/DIVU, is between 0.4 and 0.7.

7. An elongated drive string assembly according to claim 2, wherein the thread shape on each of the nipple and rod first end are trapezoidal and non-symmetric with a thread pitch of 6-8 threads per inch which are differential in diametral taper to each other, all threads on the nipple are complete and part of the thread on the rod first end is incomplete, for between 2 and 5 mm.

8. An elongated drive string assembly according to claim 2, wherein a radii at a tip of the first torque shoulder on the nipple is between 1.3 and 2.6 mm.; a radii at a tip of the second torque shoulder on the nipple is between 0.6 and 1.0 mm.; a radii at a tip of the first torque shoulder on the rod is between 0.7 and 2.0 mm.; and a radii at a tip of a second torque shoulder on the rod is between 0.7 and 1.1 mm.

9. An elongated drive string assembly according to claim 2, wherein there is a clearance, when hand-tightened, between the first torque shoulder (c1) and the second torque shoulder (c2), according to the relationship $$c2 \geqq c1, \text{ and } 0 \text{ mm} \leqq (c2-c1) \leqq 0.3 \text{ mm}.$$

10. An elongated drive string assembly according to claim 9, wherein c1 is approximately in the range of 0.4 to 2.5 mm. and c2 is approximately in the range of 0.4 to 2.8 mm.

11. An elongated drive string assembly comprising a plurality of hollow sucker rods and connecting elements with an axis, connected together and between a drive head located at the surface of an oil well and a rotary pump located deep down the oil well, wherein at least one hollow sucker rod has a first end comprising an internal female threaded surface engaging an external male threaded surface on at least one connecting element, wherein said threads are modified buttress threads with a thread pitch of 6-8 threads per inch which are differential in diametral taper to each other; the first end of said at least one hollow sucker rod further comprising an annular torque shoulder that is engaging an annular torque shoulder on said at least one connecting element and being characterized in that, for an outside diameter of the connecting element (DEN), internal diameters (DIN1, DIN2) of the connecting element, and a diameter of a first torque shoulder on the connecting element (DHT1) and a diameter of a second torque shoulder on the free end of the connecting element (DHT2), and the following ratios are maintained:

| | Range | |
|---|---|---|
| Diameter Ratios | Min. | Max. |
| DHT1/DEN | 0.7 | 0.9 |
| DIN1/DEN | 0.2 | 0.6 |
| DIN1/DHT1 | 0.3 | 0.7 |
| DIN2/DHT2 | 0.67 | 0.92 |

wherein those hollow sucker rods located proximate to each extreme end of the string have a plurality of holes extending through wall sections of those rods so as to enable fluid flowing outside of those rods to also flow within the inner bore of the drive string and between the extreme ends of said elongated drive string.

12. An elongated drive string assembly according to claim 11, being further characterized in that the free end of the at least one rod is upset, and comprises an upset rod end maximum diameter (DEVU), an upset rod end inner diameter (DIVU), a rod internal diameter at the free end (DIFR1), and the following ratios are maintained:

| | Range | |
|---|---|---|
| Diameter Ratios | Min. | Max. |
| DEVU/DIVU | 0.4 | 0.7 |
| DIFR1/DEVU | 0.75 | 0.95. |

13. An elongated drive string assembly according to claim 12, being further characterized in that, for an upset rod end inner diameter (DIVU) and a rod internal diameter at the thread inner end (DIFR2), the following ratio is maintained:

| | Range | |
|---|---|---|
| Diameter Ratios | Min. | Max. |
| DIVU/DIFR2 | 0.65 | 0.90. |

14. An elongated drive string assembly according to claim 11, wherein the plurality of holes are drilled radially through said wall sections of those sucker rods which are proximate to each extreme end of the string; the angle of torque shoulders are conical and are disposed at an angle Beta of between 80° and 90°, a radii at the tip of the first torque shoulder on the rod is between 0.7 and 2.0 mm. and a radii at the tip of the second torque shoulder is between 0.7 and 1.1 mm.

15. An elongated drive string assembly according to claim 11, wherein the plurality of holes are arranged in a symmetrical fashion about the centerline of the rod, in the wall sections of those sucker rods which are proximate to each extreme end of the string.

16. An elongated drive string assembly according to claim 11, wherein the plurality of holes comprise between about 62 and 162 holes which are arranged in sets of one to three holes at specific transverse sections spaced along the centerline of the rod, in the wall sections of those sucker rods which are proximate to each extreme end of the string.

17. An elongated drive string assembly according to claim 11, wherein the plurality of holes comprise between about 62 and 162 holes which are arranged in a helicoidal path about the centerline of the rod, in the wall sections of those sucker rods which are proximate to each extreme end of the string.

* * * * *